US010359713B2

(12) United States Patent
Shimizu et al.

(10) Patent No.: US 10,359,713 B2
(45) Date of Patent: Jul. 23, 2019

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Jun Azuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/948,825

(22) Filed: Apr. 9, 2018

(65) Prior Publication Data

US 2018/0299797 A1 Oct. 18, 2018

(30) Foreign Application Priority Data

Apr. 12, 2017 (JP) ..... 2017-078840

(51) Int. Cl.
*G03G 5/05* (2006.01)
*G03G 5/06* (2006.01)

(52) U.S. Cl.
CPC ..... *G03G 5/0567* (2013.01); *G03G 5/056* (2013.01); *G03G 5/0564* (2013.01);
(Continued)

(58) Field of Classification Search
CPC ..... G03G 5/14752; G03G 5/14786; G03G 5/0603; G03G 5/0607; G03G 5/0612;
(Continued)

(56) References Cited

U.S. PATENT DOCUMENTS 4,283,523 A * 8/1981 Salee ..... C08G 63/20 528/126
5,416,567 A * 5/1995 Toyoshima ..... G03G 15/065 399/254

(Continued)

FOREIGN PATENT DOCUMENTS

JP H10-020514 A 1/1998

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer having a single-layer structure. The photosensitive layer contains a charge generating material, an electron transport material, and a binder resin. The electron transport material includes a compound having a halogen atom and represented by a general formula (1), (2), (3), (4), or (5). The binder resin includes a polyarylate resin. The polyarylate resin includes at least one type of repeating unit each represented by general formula (11), at least one type of repeating unit each represented by general formula (12), and a terminal group represented by general formula (13). In general formula (13), $R^f$ represents a chain aliphatic group substituted by at
(Continued)

least one fluoro group. A charge of calcium carbonate charged by friction between the photosensitive layer and the calcium carbonate is at least +8.0 μC/g.

(1)

(2)

(3)

(4)

-continued (5)

(11)

(12)

(13)

17 Claims, 3 Drawing Sheets

(52) U.S. Cl.
CPC ..... *G03G 5/0603* (2013.01); *G03G 5/0607* (2013.01); *G03G 5/0609* (2013.01); *G03G 5/0612* (2013.01); *G03G 5/0618* (2013.01); *G03G 5/0631* (2013.01); *G03G 5/0653* (2013.01); *G03G 5/0677* (2013.01)

(58) Field of Classification Search
CPC .. G03G 5/0618; G03G 5/0631; G03G 5/0648; G03G 5/0567; G03G 5/0677
See application file for complete search history.

(56) References Cited

U.S. PATENT DOCUMENTS

| | | | | |
|---|---|---|---|---|
| 5,437,953 A * | 8/1995 | Russell | C09B 69/10 430/109.3 |
| 5,532,097 A * | 7/1996 | Tavernier | G03G 9/0819 430/108.2 |
| 2006/0121381 A1* | 6/2006 | McDougall | G03G 9/0806 430/108.6 |
| 2018/0246424 A1* | 8/2018 | Azuma | G03G 5/056 |

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2017-078840, filed on Apr. 12, 2017. The contents of this application are incorporated herein by reference in their entirety.

BACKGROUND

The present disclosure relates to an electrophotographic photosensitive member, a process cartridge, and an image forming apparatus.

An electrophotographic photosensitive member is used as an image bearing member in an electrophotographic image forming apparatus (for example, a printer or a multifunction peripheral). The electrophotographic photosensitive member includes a photosensitive layer. A single-layer electrophotographic photosensitive member or a multi-layer electrophotographic photosensitive member is for example used as the electrophotographic photosensitive member. The single-layer electrophotographic photosensitive member includes a photosensitive layer of a single-layer structure having a charge generation function and a charge transport function. The multi-layer electrophotographic photosensitive member includes a photosensitive layer that includes a charge generating layer having the charge generation function and a charge transport layer having the charge transport function.

A known electrophotographic photosensitive member contains for example a polyarylate resin obtained from a dibasic carboxylic acid component of a specific structure and a dihydric phenol component.

SUMMARY

An electrophotographic photosensitive member of the present disclosure includes a conductive substrate and a photosensitive layer having a single-layer structure. The photosensitive layer contains a charge generating material, an electron transport material, and a binder resin. The electron transport material includes a compound having a halogen atom and represented by a general formula (1), (2), (3), (4), or (5). The binder resin includes a polyarylate resin. The polyarylate resin includes at least one type of repeating unit each represented by a general formula (11), at least one type of repeating unit each represented by a general formula (12), and a terminal group represented by a general formula (13). A charge of calcium carbonate charged by friction between the photosensitive layer and the calcium carbonate is at least +8.0 μC/g.

(1)

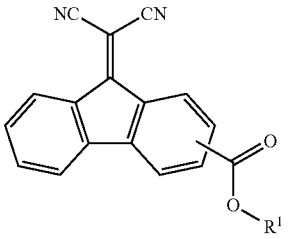

-continued (2)

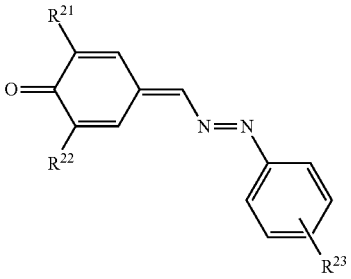

(3)

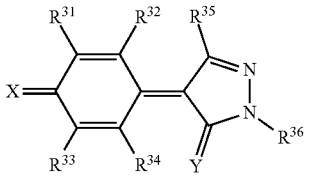

(4)

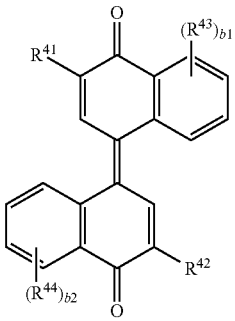

(5)

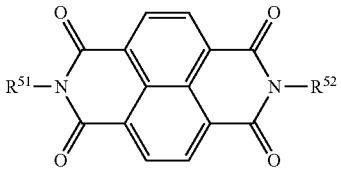

In the general formula (1), $R^1$ represents: an alkyl group having a carbon number of at least 1 and no greater than 8 and substituted by at least one halogen atom; a cycloalkyl group having a carbon number of at least 3 and no greater than 10 and substituted by at least one halogen atom; an aryl group having a carbon number of at least 6 and no greater than 14, substituted by at least one halogen atom, and optionally substituted by an alkyl group having a carbon number of at least 1 and no greater than 6; a heterocyclic group substituted by at least one halogen atom; or an aralkyl group having a carbon number of at least 7 and no greater than 20 and substituted by at least one halogen atom. In the general formula (2), $R^{21}$ and $R^{22}$ each represent, independently of each other, an alkyl group having a carbon number of at least 1 and no greater than 6, and $R^{23}$ represents a halogen atom. In the general formula (3), $R^{31}$, $R^{32}$, $R^{33}$, $R^{34}$, $R^{35}$, and $R^{36}$ each represent, independently of one another: a halogen atom; a hydrogen atom; an alkyl group having a carbon number of at least 1 and no greater than 6 and optionally substituted by at least one halogen atom; an alkenyl group having a carbon number of at least 2 and no greater than 6 and optionally substituted by at least one halogen atom; an alkoxy group having a carbon number of at least 1 and no greater than 6 and optionally substituted by at least one halogen atom; an aralkyl group having a carbon number of at least 7 and no greater than 20 and optionally substituted by at least one halogen atom; an aryl group having a carbon number of at least 6 and no greater than 14 and optionally substituted by at least one halogen atom; a heterocyclic group optionally substituted by at least one halogen atom; a cyano group; a nitro group; a hydroxyl group; a carboxyl group; or an amino group, with the proviso that at least one of $R^{31}$, $R^{32}$, $R^{33}$, $R^{34}$, $R^{35}$, and $R^{36}$ represents a halogen atom or a chemical group substituted by at least one halogen atom. X represents an oxygen atom, a sulfur atom, or $=C(CN)_2$. Y represents an oxygen atom or a sulfur atom. In the general formula (4), $R^{41}$ and $R^{42}$ each represent, independently of each other: an alkyl group having a carbon number of at least 1 and no greater than 8 and substituted by at least one halogen atom; an aryl group having a carbon number of at least 6 and no greater than 14, substituted by at least one halogen atom, and optionally substituted by an alkyl group having a carbon number of at least 1 and no greater than 6; an aralkyl group having a carbon number of at least 7 and no greater than 20 and substituted by at least one halogen atom; or a cycloalkyl group having a carbon number of at least 3 and no greater than 20 and substituted by at least one halogen atom, $R^{43}$ and $R^{44}$ each represent, independently of each other, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group, and b1 and b2 each represent, independently of each other, an integer of at least 0 and no greater than 4. In the general formula (5), $R^{51}$ and $R^{52}$ each represent, independently of each other: an aryl group having a carbon number of at least 6 and no greater than 14 and optionally substituted by at least one halogen atom; an aryl group having a carbon number of at least 6 and no greater than 14, substituted by at least one alkyl group having a carbon number of at least 1 and no greater than 6, and optionally substituted by at least one halogen atom; an aryl group having a carbon number of at least 6 and no greater than 14, substituted by at least one benzoyl group, and optionally substituted by at least one halogen atom; an aralkyl group having a carbon number of at least 7 and no greater than 20 and optionally substituted by at least one halogen atom; an alkyl group having a carbon number of at least 1 and no greater than 8 and optionally substituted by at least one halogen atom; or a cycloalkyl group having a carbon number of at least 3 and no greater than 10 and optionally substituted by at least one halogen atom, with the proviso that at least one of $R^{51}$ and $R^{52}$ represents a chemical group substituted by at least one halogen atom.

(11)

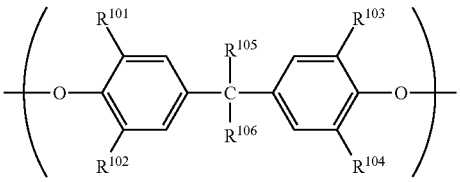

(12)

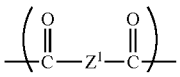

(13)

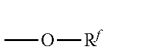

In the general formula (11), $R^{101}$, $R^{102}$, $R^{103}$, and $R^{104}$ each represent, independently of one another, a hydrogen atom or a methyl group. $R^{105}$ and $R^{106}$ each represent, independently of each other, a hydrogen atom or an alkyl group having a carbon number of at least 1 and no greater than 4. $R^{105}$ and $R^{106}$ may bond together to represent a cycloalkylidene group having a carbon number of at least 5 and no greater than 7. In the general formula (12), $Z^1$ represents a divalent group represented by a chemical formula (12A), (12B), (12C), or (12D), with the proviso that when the polyarylate resin includes only one type of repeating unit represented by the general formula (12), $Z^1$ does not represent a divalent group represented by the chemical formula (12D). In the general formula (13), $R^f$ represents a chain aliphatic group substituted by at least one fluoro group.

(12A)

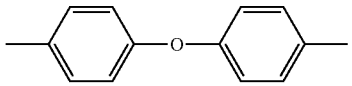

(12B)

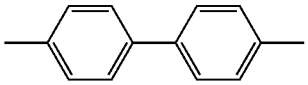

(12C)

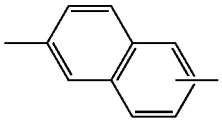

(12D)

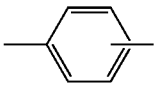

A process cartridge of the present disclosure includes the above-described electrophotographic photosensitive member.

An image forming apparatus of the present disclosure includes an image bearing member, a charger, a light exposure device, a developing device, and a transfer device. The charger charges a surface of the image bearing member. The light exposure device irradiates the charged surface of the image bearing member with light to form an electrostatic latent image on the surface of the image bearing member. The developing device develops the electrostatic latent image into a toner image. The transfer device transfers the toner image from the image bearing member onto a recording medium. Charging polarity of the charger is positive. The transfer device transfers the toner image from the image bearing member onto the recording medium in a manner that the recording medium and the surface of the image bearing member are in contact with each other. The image bearing member is the above-described electrophotographic photosensitive member.

DETAILED DESCRIPTION

Figure 1A:
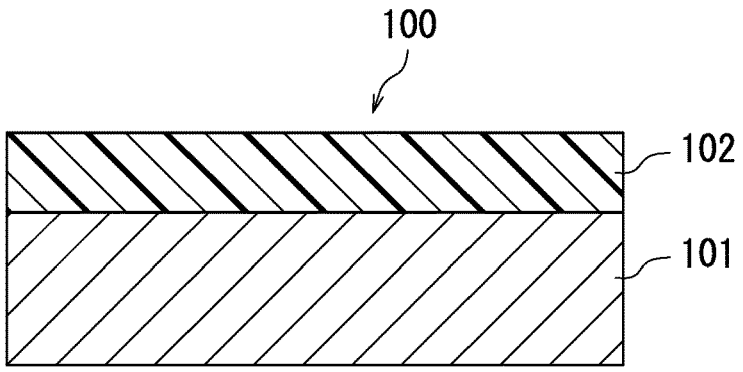
FIGS. 1A, 1B, and 1C are cross-sectional views each illustrating an example of an electrophotographic photosensitive member according to an embodiment of the present disclosure.

The following describes an embodiment of the present disclosure in detail. However, the present disclosure is by no means limited to the embodiment described below. The present disclosure may be practiced with alterations appropriately made within a scope of the object of the present disclosure. Note that although some overlapping explanations may be omitted as appropriate, such omission does not limit the gist of the present disclosure. In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

In the following description, a halogen atom, an alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 1 and no greater than 3, an alkyl group having a carbon number of at least 3 and no greater than 5, an alkoxy group having a carbon number of at least 1 and no greater than 6, an aryl group having a carbon number of at least 6 and no greater than 14, an aryl group having a carbon number of at least 6 and no greater than 10, a cycloalkyl group having a carbon number of at least 3 and no greater than 20, a cycloalkyl group having a carbon number of at least 3 and no greater than 10, a heterocyclic group, an aralkyl group having a carbon number of at least 7 and no greater than 20, an alkenyl group having a carbon number of at least 2 and no greater than 6, and cycloalkylidene group having a carbon number of at least 5 and no greater than 7 mean the followings unless otherwise stated.

Examples of the halogen atom (halogen group) include fluorine atom (fluoro group), chlorine atom (chloro group), bromine atom (bromo group), and iodine atom (iodine group).

The alkyl group having a carbon number of at least 1 and no greater than 8, the alkyl group having a carbon number of at least 1 and no greater than 6, the alkyl group having a carbon number of at least 1 and no greater than 4, the alkyl group having a carbon number of at least 1 and no greater than 3, and the alkyl group having a carbon number of at least 3 and no greater than 5 are each an unsubstituted straight or branched alkyl group. Examples of the alkyl group having a carbon number of at least 1 and no greater than 8 include methyl group, ethyl group, n-propyl group, isopropyl group, n-butyl group, sec-butyl group, tert-butyl group, n-pentyl group, isopentyl group, neopentyl group, 1,2-dimethylpropyl group, hexyl group, heptyl group, and octyl group. Examples of the alkyl group having a carbon number of at least 1 and no greater than 6 are the alkyl groups each having a carbon number of at least 1 and no greater than 6 among the above-listed examples of the alkyl group having a carbon number of at least 1 and no greater than 8. Examples of the alkyl group having a carbon number of at least 1 and no greater than 4 are the alkyl groups each having a carbon number of at least 1 and no greater than 4 among the above-listed examples of the alkyl group having a carbon number of at least 1 and no greater than 8. Examples of the alkyl group having a carbon number of at least 1 and no greater than 3 are the alkyl groups each having a carbon number of at least 1 and no greater than 3 among the above-listed examples of the alkyl group having a carbon number of at least 1 and no greater than 8. Examples of the alkyl group having a carbon number of at least 3 and no greater than 5 are the alkyl groups each having a carbon number of at least 3 and no greater than 5 among the above-listed examples of the alkyl group having a carbon number of at least 1 and no greater than 8.

The alkoxy group having a carbon number of at least 1 and no greater than 6 is an unsubstituted straight or branched alkoxy group. Examples of the alkoxy group having a carbon number of at least 1 and no greater than 6 include methoxy group, ethoxy group, n-propoxy group, isopropoxy group, n-butoxy group, sec-butoxy group, tert-butoxy group, n-pentoxy group, isopentoxy group, neopentoxy group, and hexyl group.

The aryl group having a carbon number of at least 6 and no greater than 14 and the aryl group having a carbon number of at least 6 and no greater than 10 are each an unsubstituted aryl group. Examples of the aryl group having a carbon number of at least 6 and no greater than 14 include phenyl group, naphthyl group, indacenyl group, biphenylenyl group, acenaphthylenyl group, anthryl group, and phenanthryl group. Examples of the aryl group having a carbon number of at least 6 and no greater than 10 include phenyl group and naphthyl group.

The cycloalkyl group having a carbon number of at least 3 and no greater than 20 and the cycloalkyl group having a carbon number of at least 3 and no greater than 10 are each an unsubstituted cycloalkyl group. Examples of the cycloalkyl group having a carbon number of at least 3 and no greater than 20 include cyclopropyl group, cyclobutyl group, cyclopentyl group, cyclohexyl group, cycloheptyl group, cyclooctyl group, cyclononyl group, cyclodecyl group, cycloundecyl group, cyclododecyl group, cyclotridecyl group, cyclotetradecyl group, cyclopentadecyl group, cyclohexadecyl group, cyclooctadecyl group, cyclononadecyl group, and cycloicosyl group. Examples of the cycloalkyl group having a carbon number of at least 3 and no greater than 10 are the cycloalkyl groups each having a carbon number of at least 3 and no greater than 10 among the above-listed examples of the cycloalkyl group having a carbon number of at least 3 and no greater than 20.

Examples of the heterocyclic group include heterocyclic groups having at least 5 and no greater than 14 ring members. Examples of the heterocyclic groups having at least 5 and no greater than 14 ring members include: heterocyclic group having a five- or six-member monocyclic ring including at least 1 and no greater than 3 hetero atoms other than carbon atoms; heterocyclic group resulting from condensation of two such heteromonocyclic rings; heterocyclic group resulting from condensation of such a heteromonocyclic ring and a five- or six-member monocyclic hydrocarbon ring; heterocyclic group resulting from condensation of three such heteromonocyclic rings; heterocyclic group resulting from condensation of two such heteromonocyclic rings and a five- or six-member monocyclic hydrocarbon ring; and heterocyclic group resulting from condensation of such a heteromonocyclic ring and two five- or six-member monocyclic hydrocarbon rings. The hetero atoms are at least one type of atom selected from the group consisting of nitrogen atom, sulfur atom, and oxygen atom.

Specific examples of the heterocyclic group having at least 5 and no greater than 14 ring members include piperidinyl group, piperazinyl group, morpholinyl group, thiophenyl group, furanyl group, pyrrolyl group, imidazolyl group, pyrazolyl group, isothiazolyl group, isoxazolyl group, oxazolyl group, thiazolyl group, isothiazolyl group, furazanyl group, pyranyl group, pyridyl group, pyridazinyl group, pyrimidinyl group, pyrazinyl group, indolyl group, 1H-indazolyl group, isoindolyl group, chromenyl group, quinolinyl group, isoquinolinyl group, purinyl group, pteridinyl group, triazolyl group, tetrazolyl group, 4H-quinolizinyl group, naphthyridinyl group, benzofuranyl group, 1,3-benzodioxolyl group, benzoxazolyl group, benzothiazolyl group, benzimidazolyl group, carbazolyl group, phenanthridinyl group, acridinyl group, phenazinyl group, and phenanthrolinyl group.

The aralkyl group having a carbon number of at least 7 and no greater than 20 is an unsubstituted aralkyl group. Examples of the aralkyl group having a carbon number of at least 7 and no greater than 20 are alkyl groups each having a carbon number of at least 1 and no greater than 6 and substituted by an aryl group having a carbon number of at least 6 and no greater than 14.

The alkenyl group having a carbon number of at least 2 and no greater than 6 is an unsubstituted straight or branched alkenyl group. The alkenyl group having a carbon number of at least 2 and no greater than 6 has at least one and no greater than three double bonds. Examples of the alkenyl group having a carbon number of at least 2 and no greater than 6 include ethenyl group, propenyl group, butenyl group, butadienyl group, pentenyl group, hexenyl group, hexadienyl group, and hexatrienyl group.

The cycloalkylidene group having a carbon number of at least 5 and no greater than 7 is an unsubstituted cycloalkylidene group. Examples of the cycloalkylidene group having a carbon number of at least 5 and no greater than 7 include cyclopentylidene group, cyclohexylidene group, and cycloheptylidene group. The cycloalkylidene group having a carbon number of at least 5 and no greater than 7 is represented by a general formula shown below. In the general formula, t represents an integer of at least 1 and no greater than 3, and an asterisk represents a bond. It is preferable that t represents 2.

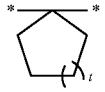

<Electrophotographic Photosensitive Member>

The present embodiment relates to an electrophotographic photosensitive member (hereinafter may be referred to as a photosensitive member). Use of the photosensitive member of the present embodiment can inhibit generation of white spots in a formed image. Reasons for this are inferred as follows.

The photosensitive member of the present embodiment includes a photosensitive layer that contains any of compounds represented by general formulas (1), (2), (3), (4), and (5) (hereinafter may be referred to as compounds (1), (2), (3), (4), and (5), respectively) as an electron transport material. The compounds (1) to (5) each have a halogen atom and a specific skeleton. The photosensitive layer also contains a polyarylate resin. The polyarylate resin includes at least one type of repeating unit each represented by general formula (11), at least one type of repeating unit each represented by general formula (12), and a terminal group represented by general formula (13). The terminal group represented by general formula (13) is substituted by at least one fluoro group and has a specific skeleton. In a configuration in which the photosensitive layer contains: the electron transport material that has a halogen atom and a specific skeleton; and the polyarylate resin that includes the terminal group substituted by at least one fluoro group and having the specific skeleton, a charge of calcium carbonate charged by friction between the photosensitive layer and calcium carbonate becomes at least +8.0 μC/g. In a situation in which the charge of calcium carbonate charged by friction between the photosensitive layer and calcium carbonate is at least +8.0 μC/g, generation of white spots in a formed image can be favorably inhibited.

Figure 1B:
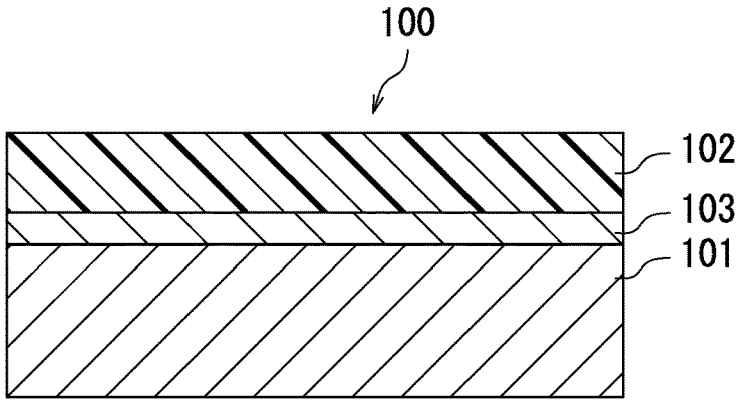
Figure 1C:
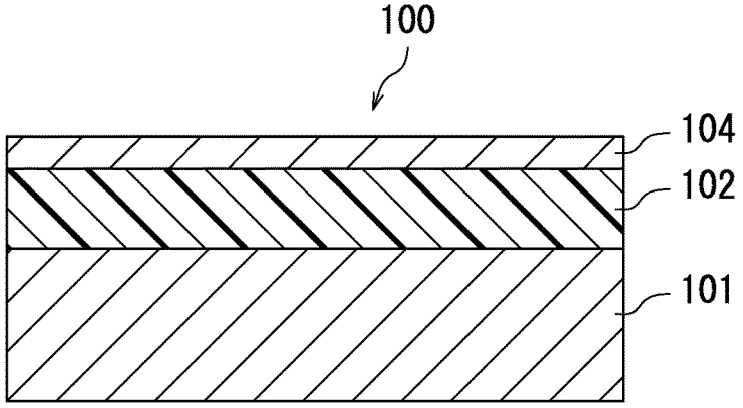

The following describes a structure of a photosensitive member 100 with reference to FIGS. 1A to 1C. FIGS. 1A to 1C are cross-sectional views each illustrating an example of the photosensitive member 100 of the present embodiment.

As illustrated in FIG. 1A, the photosensitive member 100 includes for example a conductive substrate 101 and a photosensitive layer 102. The photosensitive layer 102 has a single-layer structure. The photosensitive member 100 is a single-layer electrophotographic photosensitive member including the photosensitive layer 102 of the single-layer structure.

As illustrated in FIG. 1B, the photosensitive member 100 may include the conductive substrate 101, the photosensitive layer 102, and an intermediate layer 103 (an undercoat layer). The intermediate layer 103 is provided between the conductive substrate 101 and the photosensitive layer 102. The photosensitive layer 102 may be provided directly on the conductive substrate 101 as illustrated in FIG. 1A. Alternatively, the photosensitive layer 102 may be provided indirectly on the conductive substrate 101 with the intermediate layer 103 therebetween as illustrated in FIG. 1B.

As illustrated in FIG. 1C, the photosensitive member 100 may include the conductive substrate 101, the photosensitive layer 102, and a protective layer 104. The protective layer 104 is provided on the photosensitive layer 102.

No specific limitation is placed on the thickness of the photosensitive layer 102 as long as the photosensitive layer 102 is capable of sufficiently functioning as the photosensitive layer. The thickness of the photosensitive layer 102 is preferably at least 5 μm and no greater than 100 μm, and more preferably at least 10 μm and no greater than 50 μm.

In order to inhibit generation of white spots in a formed image, it is preferable that the photosensitive layer 102 is a topmost layer of the photosensitive member 100.

Through the above, the structure of the photosensitive member 100 has been described with reference to FIGS. 1A to 1C. The following describes more details about the photosensitive member.

<Photosensitive Layer>

The photosensitive layer contains a charge generating material, an electron transport material, and a binder resin. The photosensitive layer may contain a hole transport material. The photosensitive layer may contain an additive as necessary.

(Charge of Calcium Carbonate)

A charge (i.e., charge per mass) of calcium carbonate charged by friction between the photosensitive layer and calcium carbonate (hereinafter may be simply referred to as a charge of calcium carbonate) is at least +8.0 μC/g. Calcium carbonate is a major component of paper dust, which is an example of minute components of a recording medium.

In a situation in which the charge of calcium carbonate is smaller than +8.0 μC/g, white spots are generated in a formed image. Reasons for this are inferred as follows. In a situation in which the charge of calcium carbonate is smaller than +8.0 μC/g, minute components of the recording medium are insufficiently positively charged by friction between the photosensitive member and the recording medium through contact therebetween during image formation. Therefore, when a surface of the photosensitive member is positively charged in a charging process of image formation, minute components that are insufficiently positively charged are electrically attracted to the surface of the photosensitive member. As a result, the minute components of the recording medium tend to adhere to the surface of the photosensitive member, resulting in generation of white spots in a formed image.

In order to inhibit generation of white spots in a formed image, the charge of calcium carbonate is preferably at least +11.0 μC/g, and more preferably at least +12.0 μC/g. Although no specific limitation is placed on the upper limit of the charge of calcium carbonate as long as the photosensitive layer is capable of sufficiently functioning as the photosensitive layer of the photosensitive member, the upper limit is preferably +20.0 μC/g in terms of manufacturing costs.

Figure 2:
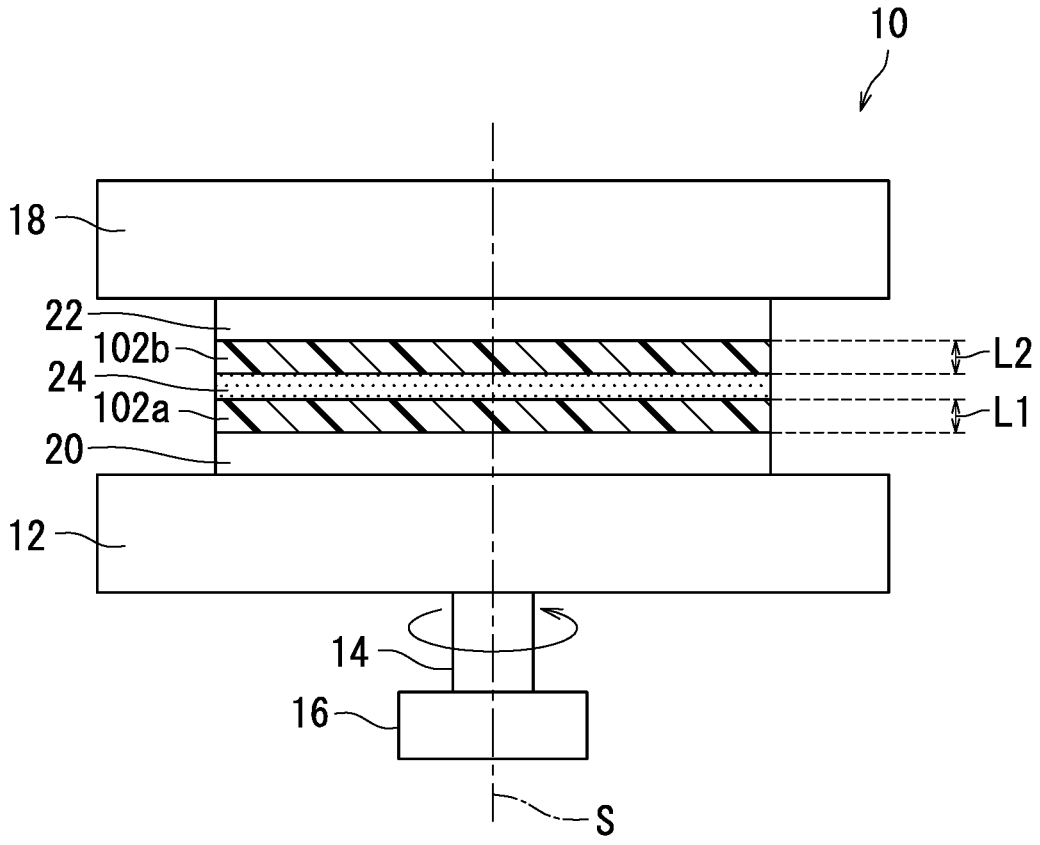
FIG. 2 is a diagram explaining a method for measuring a charge of calcium carbonate charged by friction between a photosensitive layer and calcium carbonate.

The following describes with reference to FIG. 2 a method for measuring the charge of calcium carbonate charged by friction between the photosensitive layer 102 and calcium carbonate. The charge of calcium carbonate is measured by the first through fourth steps. In the first step, two photosensitive layers 102 are prepared. One of the two photosensitive layers 102 is a first photosensitive layer 102*a*. The other of the two photosensitive layers 102 is a second photosensitive layer 102*b*. The first photosensitive layer 102*a* and the second photosensitive layer 102*b* each have a circular shape of a diameter of 3 cm. In the second step, 0.007 g of calcium carbonate is applied onto the first photosensitive layer 102*a*. Through the above, a calcium carbonate layer 24 is formed from calcium carbonate. Then, the second photosensitive layer 102*b* is superposed on the calcium carbonate layer 24. In the third step, the first photosensitive layer 102*a* is rotated at a rotational speed of 60 rpm for 60 seconds while the second photosensitive layer 102*b* is kept stationary in an environment at a temperature of 23° C. and a relative humidity of 50%. Through the above, calcium carbonate contained in the calcium carbonate layer 24 is charged by friction between the calcium carbonate and each of the first photosensitive layer 102*a* and the second photosensitive layer 102*b*. In the fourth step, the charged calcium carbonate is sucked using a charge measuring device. A total electric charge Q and a mass M of the sucked calcium carbonate are measured using the charge measuring device and a charge of calcium carbonate is calculated according to an expression Q/M. Note that the method for measuring a charge of calcium carbonate is more specifically described below in EXAMPLES. Through the above, the method for measuring a charge of calcium carbonate charged by friction between the photosensitive layer 102 and calcium carbonate has been described with reference to FIG. 2.

The charge of calcium carbonate can be adjusted for example by changing the type of the electron transport material and the number and the type of halogen atoms that the electron transport material has. The charge of calcium carbonate can also be adjusted for example by changing the type of the polyarylate resin, the type of the terminal group of the polyarylate resin, and the number of fluoro groups as substituents of the terminal group of the polyarylate resin. Further, the charge of calcium carbonate can also be adjusted for example by changing a combination of the electron transport material and the polyarylate resin.

(Electron Transport Material)

The electron transport material includes the compound (1), (2), (3), (4), or (5). The compounds (1) to (5) each have a halogen atom. The halogen atom that each of the compounds (1) to (5) has is preferably a fluorine atom or a chlorine atom, and more preferably a chlorine atom. The following describes the compounds (1) to (5).

[Compound (1)]

The compound (1) is represented by general formula (1) shown below.

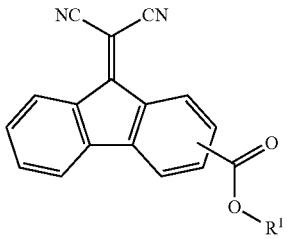

(1)

In general formula (1), $R^1$ represents: an alkyl group having a carbon number of at least 1 and no greater than 8 and substituted by at least one halogen atom; a cycloalkyl group having a carbon number of at least 3 and no greater than 10 and substituted by at least one halogen atom; an aryl group having a carbon number of at least 6 and no greater than 14, substituted by at least one halogen atom, and optionally substituted by an alkyl group having a carbon number of at least 1 and no greater than 6; a heterocyclic group substituted by at least one halogen atom; or an aralkyl group having a carbon number of at least 7 and no greater than 20 and substituted by at least one halogen atom.

In order to inhibit generation of white spots in a formed image, $R^1$ in general formula (1) preferably represents an alkyl group having a carbon number of at least 1 and no greater than 8 and substituted by at least one halogen atom.

The alkyl group having a carbon number of at least 1 and no greater than 8 represented by $R^1$ in general formula (1) is preferably an alkyl group having a carbon number of at least 1 and no greater than 6, more preferably an alkyl group having a carbon number of at least 3 and no greater than 5, and particularly preferably an n-butyl group. The alkyl group having a carbon number of at least 1 and no greater than 8 represented by $R^1$ is substituted by at least one halogen atom. The halogen atom as a substituent of the alkyl group having a carbon number of at least 1 and no greater than 8 represented by $R^1$ is preferably a chlorine atom or a fluorine atom, and more preferably a chlorine atom. The number of halogen atoms as at least one substituent of the alkyl group having a carbon number of at least 1 and no greater than 8 represented by $R^1$ is preferably 1 or 2, and more preferably 1.

The compound (1) is preferably a compound represented by chemical formula (1-E1) (hereinafter may be referred to as a compound (1-E1)).

(1-E1)

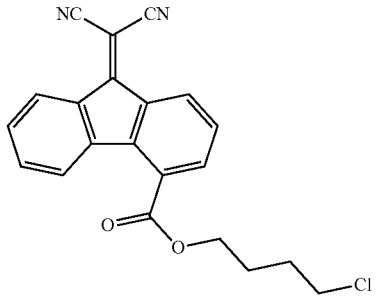

The compound (1) is produced by the following reactions (r1-1) and (r1-2) or a method in accordance therewith. A process other than these reactions may be performed as necessary. In reaction formulas representing the reactions (r1-1) and (r1-2), $R^1$ represents the same as $R^1$ in general formula (1). In the following description, compounds represented by chemical formulas (1A) to (1D) may be referred to as compounds (1A) to (1D), respectively.

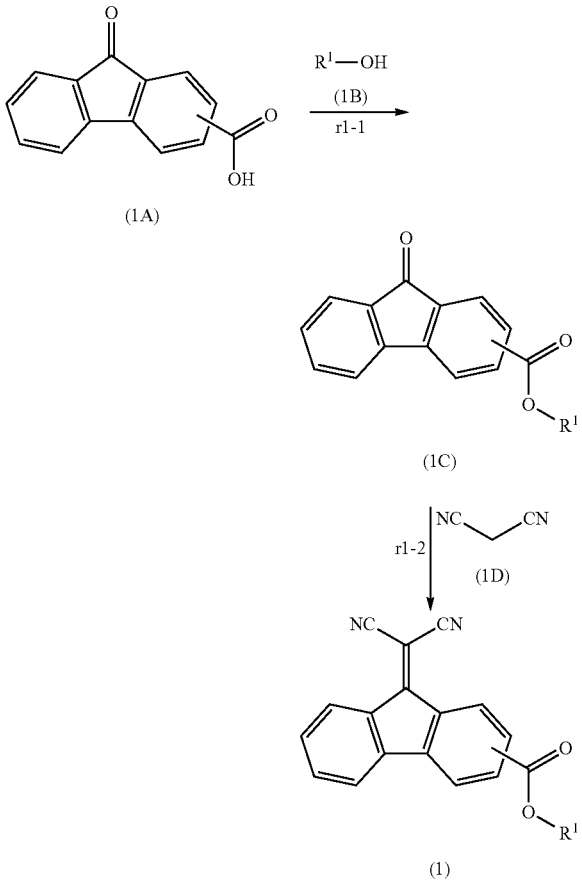

In the reaction (r1-1), 1 mol equivalent of the compound (1A) and 1 mol equivalent of the compound (1B) are caused to react with each other to yield 1 mol equivalent of the compound (1C). The reaction temperature of the reaction (r1-1) is preferably at least 80° C. and no higher than 150° C. The reaction time of the reaction (r1-1) is preferably at least two hours and no longer than ten hours. The reaction (r1-1) may be caused in the presence of a catalyst. An example of the catalyst is an acid catalyst, and a more specific example of the catalyst is p-toluenesulfonic acid. The reaction (r1-1) may be caused in a solvent. An example of the solvent is toluene.

In the reaction (r1-2), 1 mol equivalent of the compound (1C) and 1 mol equivalent of the compound (1D) (malononitrile) are caused to react with each other to yield 1 mol equivalent of the compound (1). The reaction temperature of the reaction (r1-2) is preferably at least 40° C. and no higher than 120° C. The reaction time of the reaction (r1-2) is preferably at least one hour and no longer than ten hours. The reaction (r1-2) may be caused in the presence of a catalyst. An example of the catalyst is a base catalyst, and a more specific example of the catalyst is piperidine. The reaction (r1-2) may be caused in a solvent. An example of the solvent is a polar solvent, and a more specific example of the solvent is methanol.

[Compound (2)]

The compound (2) is represented by general formula (2) shown below.

(2)

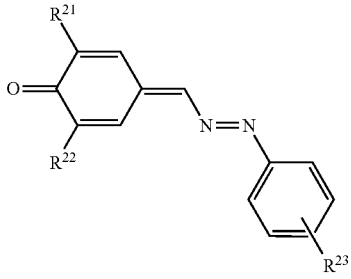

In general formula (2), $R^{21}$ and $R^{22}$ each represent, independently of each other, an alkyl group having a carbon number of at least 1 and no greater than 6. $R^{23}$ represents a halogen atom.

In order to inhibit generation of white spots in a formed image, it is preferable that in general formula (2), $R^{21}$ and $R^{22}$ each represent, independently of each other, an alkyl group having a carbon number of at least 1 and no greater than 4 and $R^{23}$ represents a halogen atom. The alkyl group having a carbon number of at least 1 and no greater than 4 is preferably a tert-butyl group. The halogen atom is preferably a chlorine atom.

The compound (2) is preferably a compound represented by chemical formula (2-E2) (hereinafter may be referred to as a compound (2-E2)). The compound (2) can be produced by a method appropriately selected from known methods.

(2-E2)

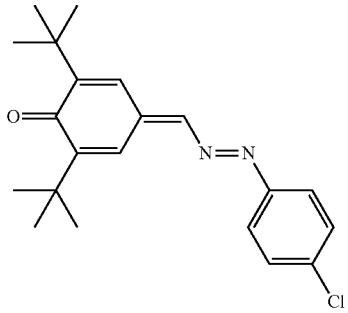

[Compound (3)]

The compound (3) is represented by general formula (3) shown below.

(3)

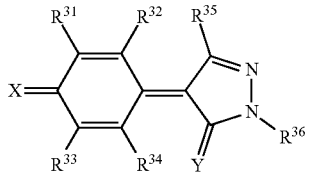

In general formula (3), $R^{31}$, $R^{32}$, $R^{33}$, $R^{34}$, $R^{35}$, and $R^{36}$ each represent, independently of one another: a halogen atom; a hydrogen atom; an alkyl group having a carbon number of at least 1 and no greater than 6 and optionally substituted by at least one halogen atom; an alkenyl group having a carbon number of at least 2 and no greater than 6 and optionally substituted by at least one halogen atom; an alkoxy group having a carbon number of at least 1 and no greater than 6 and optionally substituted by at least one halogen atom; an aralkyl group having a carbon number of at least 7 and no greater than 20 and optionally substituted by at least one halogen atom; an aryl group having a carbon number of at least 6 and no greater than 14 and optionally substituted by at least one halogen atom; a heterocyclic group optionally substituted by at least one halogen atom; a cyano group; a nitro group; a hydroxyl group; a carboxyl group; or an amino group, with the proviso that at least one of $R^{31}$, $R^{32}$, $R^{33}$, $R^{34}$, $R^{35}$, and $R^{36}$ represents a halogen atom or a chemical group substituted by at least one halogen atom. X represents an oxygen atom, a sulfur atom, or $=C(CN)_2$. Y represents an oxygen atom or a sulfur atom. Note that the chemical group substituted by at least one halogen atom is: an alkyl group having a carbon number of at least 1 and no greater than 6 and substituted by at least one halogen atom; an alkenyl group having a carbon number of at least 2 and no greater than 6 and substituted by at least one halogen atom; an alkoxy group having a carbon number of at least 1 and no greater than 6 and substituted by at least one halogen atom; an aralkyl group having a carbon number of at least 7 and no greater than 20 and substituted by at least one halogen atom; an aryl group having a carbon number of at least 6 and no greater than 14 and substituted by at least one halogen atom; or a heterocyclic group substituted by at least one halogen atom.

In order to inhibit generation of white spots in a formed image, it is preferable that in general formula (3), $R^{31}$, $R^{32}$, $R^{33}$, $R^{34}$, $R^{35}$, and $R^{36}$ each represent, independently of one another, an alkyl group having a carbon number of at least 1 and no greater than 6 or an aryl group having a carbon number of at least 6 and no greater than 14 and substituted by at least one halogen atom, X represents an oxygen atom, and Y represents an oxygen atom, with the proviso that at least one of $R^{31}$, $R^{32}$, $R^{33}$, $R^{34}$, $R^{35}$, and $R^{36}$ represents an aryl group having a carbon number of at least 6 and no greater than 14 and substituted by at least one halogen atom.

The aryl group having a carbon number of at least 6 and no greater than 14 represented by each of $R^{31}$, $R^{32}$, $R^{33}$, $R^{34}$, $R^{35}$, and $R^{36}$ is preferably an aryl group having a carbon number of at least 6 and no greater than 10, and more preferably a phenyl group. The aryl group having a carbon number of at least 6 and no greater than 14 as above may be substituted by at least one halogen atom. The halogen atom as a substituent of the aryl group having a carbon number of at least 6 and no greater than 14 is preferably a fluorine atom or a chlorine atom, and more preferably a chlorine atom. The number of halogen atoms as at least one substituent of the aryl group having a carbon number of at least 6 and no greater than 14 is preferably at least 1 and no greater than 3, and more preferably 2.

The alkyl group having a carbon number of at least 1 and no greater than 6 represented by each of $R^{31}$, $R^{32}$, $R^{33}$, $R^{34}$, $R^{35}$, and $R^{36}$ is preferably an alkyl group having a carbon number of at least 1 and no greater than 4, and more preferably a tert-butyl group or an isopropyl group.

At least one of $R^{31}$, $R^{32}$, $R^{33}$, $R^{34}$, $R^{35}$, and $R^{36}$ represents a chemical group substituted by a halogen atom. It is preferable that one or two of $R^{31}$, $R^{32}$, $R^{33}$, $R^{34}$, $R^{35}$, and $R^{36}$ represent a chemical group substituted by a halogen atom, and it is more preferable that one of $R^{31}$, $R^{32}$, $R^{33}$, $R^{34}$, $R^{35}$, and $R^{36}$ represents a chemical group substituted by a halogen atom.

The compound (3) is preferably a compound represented by chemical formula (3-E3) (hereinafter may be referred to as a compound (3-E3)). The compound (3) can be produced by a method appropriately selected from known methods.

(3-E3)

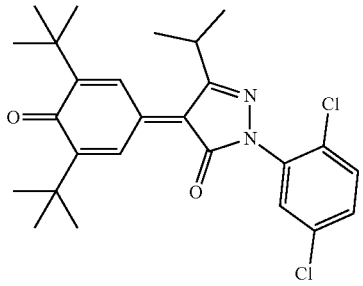

[Compound (4)]

The compound (4) is represented by general formula (4) shown below.

(4)

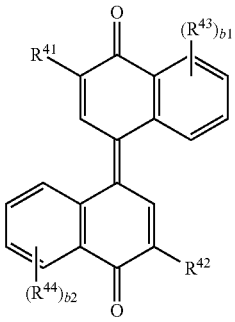

In general formula (4), $R^{41}$ and $R^{42}$ each represent, independently of each other: an alkyl group having a carbon number of at least 1 and no greater than 8 and substituted by at least one halogen atom; an aryl group having a carbon number of at least 6 and no greater than 14, substituted by at least one halogen atom, and optionally substituted by an alkyl group having a carbon number of at least 1 and no greater than 6; an aralkyl group having a carbon number of at least 7 and no greater than 20 and substituted by at least one halogen atom; or a cycloalkyl group having a carbon number of at least 3 and no greater than 20 and substituted by at least one halogen atom. $R^{43}$ and $R^{44}$ each represent, independently of each other, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group. Further, b1 and b2 each represent, independently of each other, an integer of at least 0 and no greater than 4. When b1 represents an integer of at least 2 and no greater than 4, a plurality of chemical groups $R^{43}$ may be the same as or different from one another. When b2 represents an integer of at least 2 and no greater than 4, a plurality of chemical groups $R^{44}$ may be the same as or different from one another.

In order to inhibit generation of white spots in a formed image, it is preferable that in general formula (4), $R^{41}$ and $R^{42}$ each represent, independently of each other, an alkyl group having a carbon number of at least 1 and no greater than 8 and substituted by at least one halogen atom or an aralkyl group having a carbon number of at least 7 and no greater than 20 and substituted by at least one halogen atom, and b1 and b2 each represent 0.

The alkyl group having a carbon number of at least 1 and no greater than 8 represented by each of $R^{41}$ and $R^{42}$ is preferably an alkyl group having a carbon number of at least 1 and no greater than 4, more preferably a butyl group, and further preferably a tert-butyl group. The alkyl group having a carbon number of at least 1 and no greater than 8 is substituted by at least one halogen atom. The halogen atom as a substituent of the alkyl group having a carbon number of at least 1 and no greater than 8 is preferably a chlorine atom or a fluorine atom, and more preferably a chlorine atom. The number of halogen atoms as at least one substituent of the alkyl group having a carbon number of at least 1 and no greater than 8 is preferably at least 1 and no greater than 3, and more preferably 1.

The aralkyl group having a carbon number of at least 7 and no greater than 20 represented by each of $R^{41}$ and $R^{42}$ is preferably an alkyl group having a carbon number of at least 1 and no greater than 6 and substituted by an aryl group having a carbon number of at least 6 and no greater than 10, more preferably an alkyl group having a carbon number of at least 1 and no greater than 3 and substituted by a phenyl group, and further preferably a 1-phenylethyl group. The aralkyl group having a carbon number of at least 7 and no greater than 20 is substituted by at least one halogen atom. The halogen atom as a substituent of the aralkyl group having a carbon number of at least 7 and no greater than 20 is preferably a chlorine atom or a fluorine atom, and more preferably a chlorine atom. The number of halogen atoms as at least one substituent of the aralkyl group having a carbon number of at least 7 and no greater than 20 is preferably at least 1 and no greater than 3, and more preferably 1. Note that either of an aryl moiety and an alkyl moiety of the aralkyl group having a carbon number of at least 7 and no greater than 20 may be substituted by a halogen atom.

The compound (4) is preferably either of a compound represented by chemical formula (4-E4) and a compound represented by chemical formula (4-E5) (hereinafter may be referred to as a compound (4-E4) and a compound (4-E5), respectively).

(4-E4)

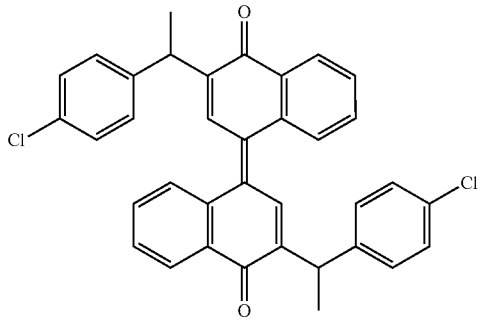

(4-E5)

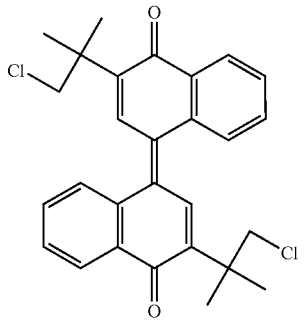

The compound (4) is produced for example by the following reactions (r4-1) to (r4-3) or a method in accordance therewith. A process other than these reactions may be performed as necessary. In chemical formulas (4A) to (4F) representing the reactions (r4-1) to (r4-3), $R^{41}$, $R^{42}$, $R^{43}$, $R^{44}$, b1, and b2 represent the same as $R^{41}$, $R^{42}$, $R^{43}$, $R^{44}$, b1, and b2 in general formula (4), respectively. In the following description, compounds represented by chemical formulas (4A), (4B), (4C), (4D), (4E), and (4F) may be referred to as compounds (4A), (4B), (4C), (4D), (4E), and (4F), respectively.

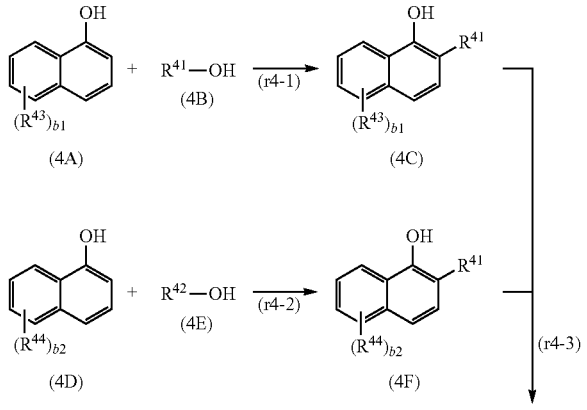

-continued

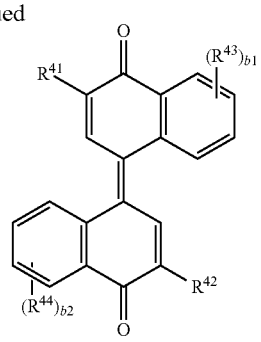

(4)

In the reaction (r4-1), 1 mol equivalent of the compound (4A) and 1 mol equivalent of the compound (4B) are caused to react with each other in the presence of a concentrated sulfuric acid to yield 1 mol equivalent of the compound (4C). The reaction temperature of the reaction (r4-1) is preferably room temperature (for example, 25° C.). The reaction time of the reaction (r4-1) is preferably at least one hour and no longer than ten hours. The reaction (r4-1) may be caused in a solvent. An example of the solvent is an acetic acid.

The reaction (r4-2) can be carried out in the same manner as the reaction (r4-1) in all aspects other than the following changes. Specifically, 1 mol equivalent of the compound (4D) is used instead of 1 mol equivalent of the compound (4A). Also, 1 mol equivalent of the compound (4E) is used instead of 1 mol equivalent of the compound (4B). As a result, the compound (4F) is yielded by the reaction (r4-2) instead of the compound (4C).

In the reaction (r4-3), 1 mol equivalent of the compound (4C) and 1 mol equivalent of the compound (4F) are caused to react with each other in the presence of an oxidant to yield the compound (4). An example of the oxidant is chloranil. The reaction temperature of the reaction (r4-3) is preferably room temperature (for example, 25° C.). The reaction time of the reaction (r4-3) is preferably at least one hour and no longer than ten hours. An example of a solvent is chloroform.

[Compound (5)]

The compound (5) is represented by general formula (5) shown below.

(5)

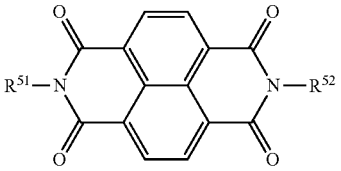

In general formula (5), $R^{51}$ and $R^{52}$ each represent, independently of each other: an aryl group having a carbon number of at least 6 and no greater than 14 and optionally substituted by at least one halogen atom; an aryl group having a carbon number of at least 6 and no greater than 14, substituted by at least one alkyl group having a carbon number of at least 1 and no greater than 6, and optionally substituted by at least one halogen atom; an aryl group having a carbon number of at least 6 and no greater than 14, substituted by at least one benzoyl group, and optionally substituted by at least one halogen atom; an aralkyl group having a carbon number of at least 7 and no greater than 20 and optionally substituted by at least one halogen atom; an alkyl group having a carbon number of at least 1 and no greater than 8 and optionally substituted by at least one halogen atom; or a cycloalkyl group having a carbon number of at least 3 and no greater than 10 and optionally substituted by at least one halogen atom. At least one of $R^{51}$ and $R^{52}$ represents a chemical group substituted by at least one halogen atom. The chemical group substituted by at least one halogen atom is: an aryl group having a carbon number of at least 6 and no greater than 14 and substituted by at least one halogen atom; an aryl group having a carbon number of at least 6 and no greater than 14 and substituted by at least one halogen atom and at least one alkyl group having a carbon number of at least 1 and no greater than 6; an aryl group having a carbon number of at least 6 and no greater than 14 and substituted by at least one halogen atom and at least one benzoyl group; an aralkyl group having a carbon number of at least 7 and no greater than 20 and substituted by at least one halogen atom; an alkyl group having a carbon number of at least 1 and no greater than 8 and substituted by at least one halogen atom; or a cycloalkyl group having a carbon number of at least 3 and no greater than 10 and substituted by at least one halogen atom.

In order to inhibit generation of white spots in a formed image, it is preferable that in general formula (5), $R^{51}$ and $R^{52}$ each represent, independently of each other: an aryl group having a carbon number of at least 6 and no greater than 14, substituted by at least one alkyl group having a carbon number of at least 1 and no greater than 6, and optionally substituted by at least one halogen atom; or an aralkyl group having a carbon number of at least 7 and no greater than 20 and optionally substituted by at least one halogen atom, with the proviso that at least one of $R^{51}$ and $R^{52}$ represents a chemical group substituted by at least one halogen atom.

The following describes a configuration in which $R^{51}$ and $R^{52}$ each represent an aryl group having a carbon number of at least 6 and no greater than 14, substituted by at least one alkyl group having a carbon number of at least one 1 and no greater than 6, and optionally substituted by at least one halogen atom. The aryl group having a carbon number of at least 6 and no greater than 14 represented by each of $R^{51}$ and $R^{52}$ is preferably an aryl group having a carbon number of at least 6 and no greater than 10, and more preferably a phenyl group. The aryl group having a carbon number of at least 6 and no greater than 14 is substituted by at least one alkyl group having a carbon number of at least 1 and no greater than 6. The alkyl group having a carbon number of at least 1 and no greater than 6 as a substituent of the aryl group having a carbon number of at least 6 and no greater than 14 is preferably an alkyl group having a carbon number of at least 1 and no greater than 3, and more preferably a methyl group or an ethyl group. The number of alkyl groups having a carbon number of at least 1 and no greater than 6 as at least one substituent of the aryl group having a carbon number of at least 6 and no greater than 14 is preferably at least 1 and no greater than 3, more preferably 1 or 2, and further preferably 2. The aryl group having a carbon number of at least 6 and no greater than 14 may be further substituted by at least one halogen atom. The halogen atom as a substituent of the aryl group having a carbon number of at least 6 and no greater than 14 is preferably a chlorine atom or a fluorine atom, and more preferably a chlorine atom. The number of halogen atoms as at least one substituent of the aryl group having a carbon number of at least 6 and no greater than 14 is preferably at least 1 and no greater than 3, more preferably 1 or 2, and further preferably 2.

The following describes a configuration in which $R^{51}$ and $R^{52}$ each represent an aralkyl group having a carbon number of at least 7 and no greater than 20 and optionally substituted by at least one halogen atom. The aralkyl group having a carbon number of at least 7 and no greater than 20 represented by each of $R^{51}$ and $R^{52}$ is preferably an alkyl group having a carbon number of at least 1 and no greater than 6 and substituted by an aryl group having a carbon number of at least 6 and no greater than 10, more preferably an alkyl group having a carbon number of at least 1 and no greater than 3 and substituted by a phenyl group, and further preferably a 1-phenylethyl group. The aralkyl group having a carbon number of at least 7 and no greater than 20 may be substituted by at least one halogen atom. The halogen atom as a substituent of the aralkyl group having a carbon number of at least 7 and no greater than 20 is preferably a chlorine atom or a fluorine atom, and more preferably a chlorine atom. The number of halogen atoms as at least one substituent of the aralkyl group having a carbon number of at least 7 and no greater than 20 is preferably at least 1 and no greater than 3, more preferably 1 or 2, and further preferably 2. Note that either of an aryl moiety and an alkyl moiety of the aralkyl group having a carbon number of at least 7 and no greater than 20 may be substituted by a halogen atom.

At least one of $R^{51}$ and $R^{52}$ represents a chemical group substituted by at least one halogen atom. It is preferable that one of $R^{51}$ and $R^{52}$ represents a chemical group substituted by at least one halogen atom and the other of $R^{51}$ and $R^{52}$ represents a chemical group that is not substituted by a halogen atom.

In order to inhibit generation of white spots in a formed image, it is preferable that in general formula (5), $R^{51}$ represents an aralkyl group having a carbon number of at least 7 and no greater than 20 and substituted by at least one (preferably at least one and no greater than three, more preferably one or two) halogen atom and $R^{52}$ represents an aryl group having a carbon number of at least 6 and no greater than 14 and substituted by at least one (preferably at least one and no greater than three, more preferably one or two) alkyl group having a carbon number of at least 1 and no greater than 6.

The compound (5) is preferably a compound represented by chemical formula (5-E6) (hereinafter may be referred to as a compound (5-E6)).

(5-E6)

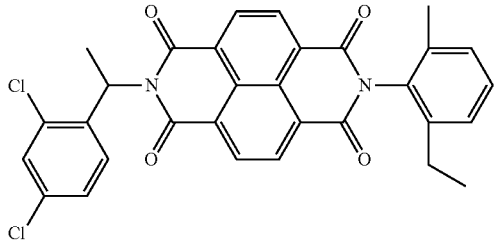

The compound (5) is produced for example by the following reactions (r5-1) to (r5-3) or a method in accordance therewith. A process other than these reactions may be performed as necessary. In chemical formulas (5A) to (5E) representing the reactions (r5-1) to (r5-3), $R^{51}$ and $R^{52}$ represent the same as $R^{51}$ and $R^{52}$ in general formula (5), respectively, and $R^{53}$ represents an alkyl group. In the following description, compounds represented by chemical formulas (5A), (5B), (5C), (5D), and (5E) may be referred to as compounds (5A), (5B), (5C), (5D), and (5E), respectively.

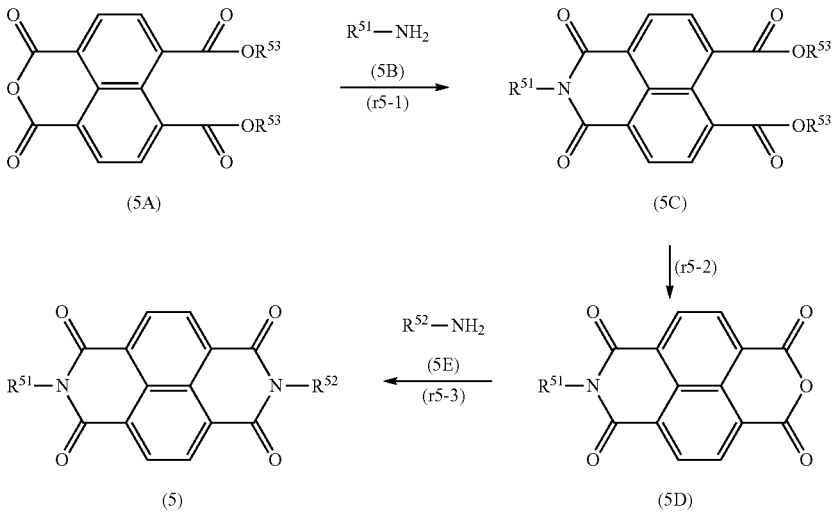

In the reaction (r5-1), 1 mol equivalent of the compound (5A) and 1 mol equivalent of the compound (5B) are caused to react with each other in the presence of a base to yield 1 mol equivalent of the compound (5C). The reaction temperature of the reaction (r5-1) is preferably at least 80° C. and no higher than 150° C. The reaction time of the reaction (r5-1) is preferably at least one hour and no longer than eight hours. The reaction (r5-1) may be caused in a solvent. An example of the solvent is dioxane. In terms of improvement of the yield of the compound (5C), it is preferable that nucleophilicity of the base is low. An example of such a base is N,N-diisopropylethylamine (Hunig base).

In the reaction (r5-2), 1 mol equivalent of the compound (5C) is caused to react in the presence of an acid to yield 1 mol equivalent of the compound (5D). In the reaction (r5-2), a dicarboxylic acid is formed by hydrolysis of an ester of the compound (5C) in the presence of the acid, and a carboxylic anhydride is formed by cyclization of the dicarboxylic acid. Through the above, the compound (5D) is yielded. The reaction time of the reaction (r5-2) is preferably at least five hours and no longer than 30 hours. The reaction temperature of the reaction (r5-2) is preferably at least 70° C. and no higher than 150° C. The acid is preferably a trifluoroacetic acid, for example. The acid may function as a solvent.

In the reaction (r5-3), 1 mol equivalent of the compound (5D) and 1 mol equivalent of the compound (5E) are caused to react with each other in the presence of a base to yield 1 mol equivalent of the compound (5). The reaction temperature of the reaction (r5-3) is preferably at least 80° C. and no higher than 150° C. The reaction time of the reaction (r5-3) is preferably at least one hour and no longer than eight hours. The reaction (r5-3) may be caused in a solvent. An example of the solvent is dioxane. In terms of improvement of the yield of the compound (5), it is preferable that nucleophilicity of the base is low. An example of such a base is N,N-diisopropylethylamine (Hunig base).

In a configuration for favorably inhibiting generation of white spots in a formed image, the electron transport material is preferably the compound (1), (4), or (5), and more preferably the compound (1-E1), (4-E4), (4-E5), or (5-E6).

In another configuration for favorably inhibiting generation of white spots in a formed image, the electron transport material is preferably the compound (3), (4), or (5), and more preferably the compound (3-E3), (4-E4), (4-E5), or (5-E6).

In yet another configuration for favorably inhibiting generation of white spots in a formed image, the electron transport material is preferably the compound (2), and more preferably the compound (2-E2).

The photosensitive layer may contain one of the compounds (1), (2), (3), (4), and (5) alone as the electron transport material or two or more of the compounds (1), (2), (3), (4), and (5) in combination as the electron transport material. The photosensitive layer may contain only the compound (1), (2), (3), (4) or (5) as the electron transport material. Alternatively, the photosensitive layer may further contain an electron transport material other than the compounds (1) to (5) (hereinafter may be referred to as an additional electron transport material) in addition to the compounds (1) to (5).

Examples of the additional electron transport material include quinone compounds, diimide-based compounds, hydrazone-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride, all of which are other than the compounds (1) to (5). Examples of the quinone compounds include diphenoquinone compounds, azoquinone compounds, anthraquinone compounds, naphthoquinone compounds, nitroanthraquinone compounds, and dinitroanthraquinone compounds. One of the above-listed additional electron transport materials may be used alone or two or more of the above-listed additional electron transport materials may be used in combination.

The amount of the electron transport material is preferably at least 5 parts by mass and no greater than 100 parts by mass relative to 100 parts by mass of the binder resin, and more preferably at least 20 parts by mass and no greater than 40 parts by mass. In a configuration in which the amount of the electron transport material is at least 5 parts by mass relative to 100 parts by mass of the binder resin, sensitivity characteristics of the photosensitive member can be easily improved. In a configuration in which the amount of the electron transport material is no greater than 100 parts by mass relative to 100 parts by mass of the binder resin, the electron transport material can be readily dissolved in a solvent used for formation of the photosensitive layer, and the photosensitive layer can be easily formed uniformly.

(Binder Resin)

The binder resin includes a polyarylate resin. The polyarylate resin includes at least one type of repeating unit each represented by general formula (11), at least one type of repeating unit each represented by general formula (12), and a terminal group represented by general formula (13). In the following description, the polyarylate resin including at least one type of repeating unit each represented by general formula (11), at least one type of repeating unit each represented by general formula (12), and the terminal group represented by general formula (13) may be referred to as a polyarylate resin (PA). Also, a repeating unit represented by general formula (11), a repeating unit represented by general formula (12), and the terminal group represented by general formula (13) may be referred to as a repeating unit (11), a repeating unit (12), and a terminal group (13), respectively.

(11)

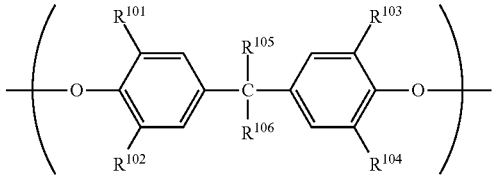

(12)

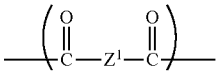

(13)

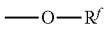

In general formula (11), $R^{101}$, $R^{102}$, $R^{103}$, and $R^{104}$ each represent, independently of one another, a hydrogen atom or a methyl group. $R^{105}$ and $R^{106}$ each represent, independently of each other, a hydrogen atom or an alkyl group having a carbon number of at least 1 and no greater than 4. $R^{105}$ and $R^{106}$ may bond together to represent a cycloalkylidene group having a carbon number of at least 5 and no greater than 7. In general formula (12), $Z^1$ represents a divalent group represented by chemical formula (12A), (12B), (12C), or (12D), with the proviso that when the polyarylate resin (PA) includes only one type of repeating unit (12), $Z^1$ does not represent a divalent group represented by chemical formula (2D). In general formula (13), $R^f$ represents a chain aliphatic group substituted by at least one fluoro group.

(12A)

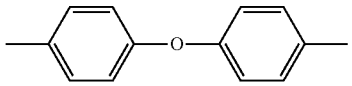

(12B)

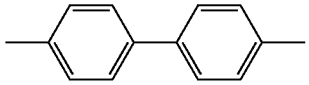

-continued (12C)

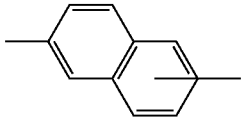

(12D)

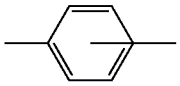

The polyarylate resin (PA) has a main chain and the terminal group. The following describes the main chain and the terminal group of the polyarylate resin (PA).

[Main Chain]

The main chain of the polyarylate resin (PA) includes at least one type of repeating unit (11) and at least one type of repeating unit (12).

The main chain of the polyarylate resin (PA) has no halogen atom. As a result of the terminal group (13) being substituted by a fluoro group and the main chain having no halogen atom, generation of white spots in a formed image can be inhibited. Also, it is thought that as a result of the terminal group (3) being substituted by a fluoro group and the main chain having no halogen atom, compatibility of the polyarylate resin (PA) with a hole transport material improves and crystallization of the photosensitive layer can be favorably inhibited. Further, it is thought that as a result of the terminal group (13) being substituted by a fluoro group and the main chain having no halogen atom, the main chain tends to be entangled, enabling improvement in crack resistance and mechanical strength of the photosensitive layer.

The following describes the repeating unit (11). The alkyl group having a carbon number of at least 1 and no greater than 4 represented by each of $R^{105}$ and $R^{106}$ in general formula (11) is preferably a methyl group or an ethyl group, and more preferably a methyl group.

The cycloalkylidene group having a carbon number of at least 5 and no greater than 7 that is a chemical group as a result of bonding between $R^{105}$ and $R^{106}$ in general formula (11) is preferably a cyclopentylidene group or a cyclohexylidene group, and more preferably a cyclohexylidene group.

Preferable examples of the repeating unit (11) include repeating units represented by chemical formulas (11-1), (11-2), (11-3), and (11-4). In the following description, the repeating units represented by chemical formulas (11-1), (11-2), (11-3), and (11-4) may be referred to as repeating units (11-1), (11-2), (11-3), and (11-4), respectively.

(11-1)

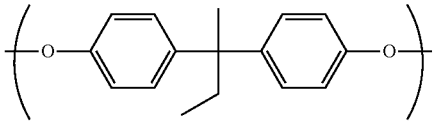

(11-2)

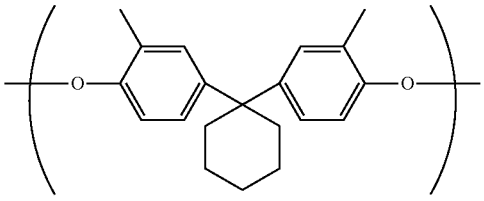

-continued (11-3)

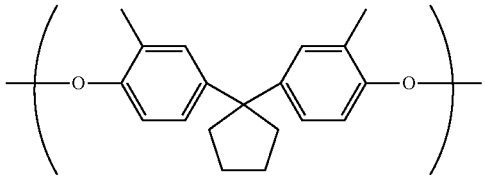

(11-4)

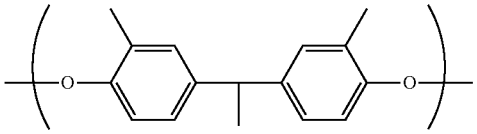

In order to further inhibit generation of white spots in a formed image, it is preferable that in general formula (11), $R^{101}$ and $R^{103}$ each represent a methyl group, $R^{102}$ and $R^{104}$ each represent a hydrogen atom, and $R^{105}$ and $R^{106}$ bond together to represent a cycloalkylidene group having a carbon number of at least 5 and no greater than 7. Among repeating units (11) satisfying the above, the repeating units (11-2) and (11-3) are preferable, and the repeating unit (11-2) is more preferable.

In order to further inhibit generation of white spots in a formed image, it is also preferable that in general formula (11), $R^{101}$, $R^{103}$, and $R^{106}$ each represent a methyl, group and $R^{12}$, $R^{104}$, and $R^{105}$ each represent a hydrogen atom. A repeating unit (11) satisfying the above is the repeating unit (11-4).

The polyarylate resin (PA) may include only one type of repeating unit (11). Alternatively, the polyarylate resin (PA) may include two or more types (for example, two types) of repeating units (11).

The following describes the repeating unit (12). Examples of the repeating unit (12) include repeating units represented by general formulas (12-1) and (12-2). In the following description, the repeating units represented by general formulas (12-1) and (12-2) may be referred to as repeating units (12-1) and (12-2), respectively. In general formula (12-2), $Z^2$ represents a divalent group represented by chemical formula (12A), (12B), or (12D).

(12-1)

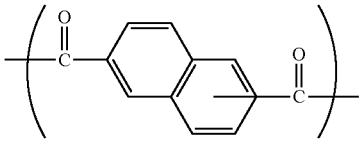

(12-2)

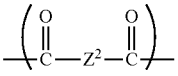

An example of the repeating unit (12-1) is a repeating unit represented by chemical formula (12-1C) (hereinafter may be referred to as a repeating unit (12-1C)).

(12-1C)

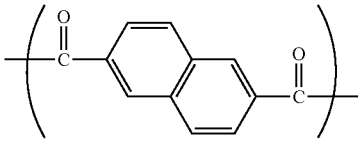

Examples of the repeating unit (12-2) include repeating units represented by chemical formulas (12-2A), (12-2B), (12-2D), and (12-2E). In the following description, the repeating units represented by chemical formulas (12-2A), (12-2B), (12-2D), and (12-2E) may be referred to as repeating units (12-2A), (12-2B), (12-2D), and (12-2E), respectively. Preferable examples of the repeating unit (12-2) include the repeating units (12-2A), (12-2B), and (12-2D).

(12-2A)

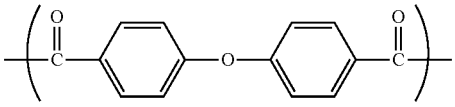

(12-2B)

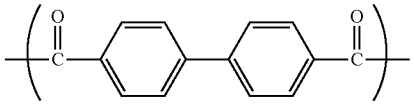

(12-2D)

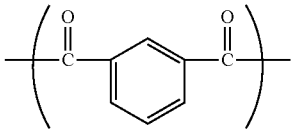

(12-2E)

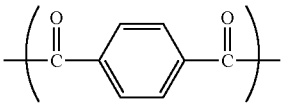

The polyarylate resin (PA) may include only one type of repeating unit (12). When the polyarylate resin (PA) includes only one type of repeating unit (12), $Z^1$ does not represent a divalent group represented by chemical formula (12D). That is, when the polyarylate resin (PA) includes only one type of repeating unit (12), $Z^1$ represents a divalent group represented by chemical formula (12A), (12B), or (12C). When the polyarylate resin (PA) includes only one type of repeating unit (12), $Z^1$ preferably represents a divalent group represented by chemical formula (12A).

In order to inhibit generation of white spots in a formed image, it is preferable that the polyarylate resin (PA) includes at least two types (for example, two types) of repeating units (12). For the same reason as above, it is more preferable that the polyarylate resin (PA) includes at least two types of repeating units (12) that include at least the repeating unit (12-1) and the repeating unit (12-2). For the same reason as above, it is further preferable that the polyarylate resin (PA) includes two types of repeating units (12) that are the repeating unit (12-1) and the repeating unit (12-2).

In order to further inhibit generation of white spots in a formed image, it is preferable that the polyarylate resin (PA) includes the repeating unit (12-1C) and the repeating unit (12-2A) as the repeating units (12). For the same reason as above, it is also preferable that the polyarylate resin (PA) includes the repeating unit (12-1C) and the repeating unit (12-2B) as the repeating units (12). For the same reason as above, it is also preferable that the polyarylate resin (PA) includes the repeating unit (12-1C) and the repeating unit (12-2D) as the repeating units (12).

In order to further inhibit generation of white spots in a formed image, it is preferable that a ratio of the number of repeating units (12-1) to a sum of the number of the repeating units (12-1) and the number of repeating units (12-2) (hereinafter may be referred to as a ratio p) is at least 0.10 and no greater than 1.00. In order to further inhibit generation of white spots in a formed image, the ratio p is more preferably at least 0.20, further preferably at least 0.30, still more preferably at least 0.40, and particularly preferably at least 0.60. Although no specific limitation is placed on the upper limit value of the ratio p as long as it is smaller than 1.00, the upper limit value of the ratio p is for example 0.70 in terms of workability.

In order to further inhibit generation of white spots in a formed image, it is preferable that a ratio of the number of the repeating units (12-2) to the sum of the number of the repeating units (12-1) and the number of the repeating units (12-2) (hereinafter may be referred to as a ratio q) is greater than 0.00 and no greater than 0.90. In order to further inhibit generation of white spots in a formed image, the ratio q is more preferably no greater than 0.80, further preferably no greater than 0.70, still more preferably no greater than 0.60, and particularly preferably no greater than 0.40. Although no specific limitation is placed on the lower limit value of the ratio q as long as it is greater than 0.00, the lower limit value of the ratio q is for example 0.30 in terms of workability.

Each of the ratios p and q is not a value calculated for a single molecular chain, and is an average value of values calculated for the whole polyarylate resin (PA) (a plurality of molecular chains) contained in the photosensitive layer. The ratios p and q can be calculated from a $^1$H-NMR spectrum of the polyarylate resin (PA) measured using a proton nuclear magnetic resonance spectrometer.

[Terminal Group]

The polyarylate resin (PA) includes the terminal group (13). $R^f$ in general formula (13) represents a chain aliphatic group. The chain aliphatic group is substituted by at least one fluoro group. The chain aliphatic group is for example a straight or branched chain aliphatic group. The number of fluoro groups as at least one substituent of the chain aliphatic group is at least 1 and no greater than 13. Note that the terminal group (13) is non-cyclic. As a result of the terminal group (13) being non-cyclic and including a chain aliphatic group, generation of white spots in a formed image can be inhibited.

A preferable example of the terminal group (13) is a terminal group represented by general formula (13-1) (hereinafter may be referred to as a terminal group (13-1)). In a configuration in which the polyarylate resin (PA) includes the terminal group (13-1), generation of white spots in a formed image can be further inhibited.

(13-1)

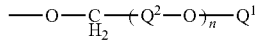

In general formula (13-1), $Q^1$ represents a straight or branched perfluoroalkyl group having a carbon number of at least 1 and no greater than 6. $Q^2$ represents a straight or branched perfluoroalkylene group having a carbon number of at least 1 and no greater than 6. Further, n represents an integer of at least 0 and no greater than 2. When n represents 2, two chemical groups $Q^2$ may be the same as or different from each other.

The straight or branched perfluoroalkyl group having a carbon number of at least 1 and no greater than 6 represented by $Q^1$ in general formula (13-1) is preferably a straight or branched perfluoroalkyl group having a carbon number of at least 3 and no greater than 6, more preferably a straight perfluoroalkyl group having a carbon number of at least 3 and no greater than 6, and further preferably a heptafluoro-n-propyl group or a tridecafluoro-n-hexyl group.

The straight or branched perfluoroalkylene group having a carbon number of at least 1 and no greater than 6 represented by $Q^2$ in general formula (13-1) is preferably a straight or branched perfluoroalkylene group having a carbon number of 2 or 3, and more preferably a 1-fluoro-1-trifluoromethyl-methylene group or a 1,1,2-trifluoro-2-trifluoromethyl-ethylene group.

It is preferable that n represents 0 or 2.

Further preferable examples of the terminal group (13) include terminal groups represented by chemical formulas (M1), (M2), (M3), and (M4). In the following description, the terminal groups represented by chemical formulas (M1), (M2), (M3), and (M4) may be referred to as terminal groups (M1), (M2), (M3), and (M4), respectively. The terminal group (13) is preferably the terminal group (13-1), which is preferably the terminal group (M1), (M2), (M3), or (M4). In a configuration in which the polyarylate resin (PA) includes the terminal group (M1), (M2), (M3), or (M4), generation of white spots in a formed image can be significantly inhibited.

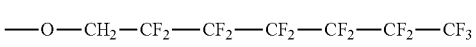
(M1)

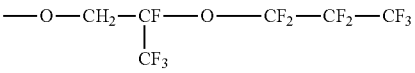
(M2)

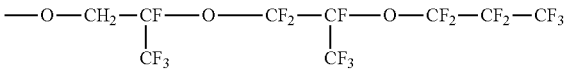
(M3)

(M4)

Among the terminal groups (M1), (M2), (M3), and (M4), the terminal groups (M1), (M3), and (M4) are preferable, and the terminal group (M3) is particularly preferable in terms of further inhibition of generation of white spots in a formed image.

Through the above, the main chain and the terminal group of the polyarylate resin (PA) have been described. The following further describes the polyarylate resin (PA).

When in general formula (11), $R^{101}$ and $R^{103}$ each represent a methyl group, $R^{102}$ and $R^{104}$ each represent a hydrogen atom, and $R^{105}$ and $R^{106}$ bond together to represent a cycloalkylidene group having a carbon number of at least 5 and no greater than 7, it is preferable that the polyarylate resin (PA) includes any of the following combinations of at least one type of repeating unit (11), at least one type of repeating unit (12), and the terminal group (13) in order to inhibit generation of white spots in a formed image. That is:

the at least one type of repeating unit (11) includes the repeating unit (11-2), the at least one type of repeating unit (12) includes the repeating units (12-1C) and (12-2A), and the terminal group (13) is the terminal group (M1), (M2), (M3), or (M4);

the at least one type of repeating unit (11) includes the repeating unit (11-2), the at least one type of repeating unit (12) includes the repeating units (12-1C) and (12-2B), and the terminal group (13) is the terminal group (M1), (M2), (M3), or (M4); or the at least one type of repeating unit (11) includes the repeating unit (11-2), the at least one type of repeating unit (12) includes the repeating units (12-1C) and (12-2D), and the terminal group (13) is the terminal group (M1), (M2), (M3), or (M4).

Among the above combinations, the combinations in which the terminal group (13) is the terminal group (M1), (M3), or (M4) are more preferable. That is, the polyarylate resin (PA) including any of the following combinations of at least one type of repeating unit (11), at least one type of repeating unit (12), and the terminal group (13) is more preferable. That is:

the at least one type of repeating unit (11) includes the repeating unit (11-2), the at least one type of repeating unit (12) includes the repeating units (12-1C) and (12-2A), and the terminal group (13) is the terminal group (M1), (M3), or (M4);

the at least one type of repeating unit (11) includes the repeating unit (11-2), the at least one type of repeating unit (12) includes the repeating units (12-1C) and (12-2B), and the terminal group (13) is the terminal group (M1), (M3), or (M4); or the at least one type of repeating unit (11) includes the repeating unit (11-2), the at least one type of repeating unit (12) includes the repeating units (12-1C) and (12-2D), and the terminal group (13) is the terminal group (M1), (M3), or (M4).

When in general formula (11), $R^{101}$ and $R^{103}$ each represent a methyl group, $R^{102}$ and $R^{104}$ each represent a hydrogen atom, and $R^{105}$ and $R^{106}$ bond together to represent a cycloalkylidene group having a carbon number of at least 5 and no greater than 7, it is further preferable that the polyarylate resin (PA) includes the repeating unit (11-2) as the at least one type of repeating unit (11), the repeating units (12-1C) and (12-2A) as the at least one type of repeating unit (12), and the terminal group (M1) as the terminal group (13) in order to further inhibit generation of white spots in a formed image.

When in general formula (11), $R^{101}$ and $R^{103}$ each represent a methyl group, $R^{102}$ and $R^{104}$ each represent a hydrogen atom, and $R^{105}$ and $R^{106}$ bond together to represent a cycloalkylidene group having a carbon number of at least 5 and no greater than 7, it is also further preferable that the polyarylate resin (PA) includes the repeating units (11-2), (12-1C), and (12-2B) and the terminal group (M1) in order to further inhibit generation of white spots in a formed image. In this configuration, the at least one type of repeating unit (11) includes the repeating unit (11-2), the at least one type of repeating unit (12) includes the repeating units (12-1C) and (12-2B), and the terminal group (13) is the terminal group (M1).

When in general formula (11), $R^{101}$, $R^{103}$, and $R^{106}$ each represent a methyl group and $R^{102}$, $R^{104}$, and $R^{105}$ each represent a hydrogen atom, it is more preferable that the at least one type of repeating unit (11) includes the repeating unit (11-4), the at least one type of repeating unit (12) includes the repeating units (12-1C) and (12-2A), and the terminal group (13) is the terminal group (M1) in order to inhibit generation of white spots in a formed image.

In the polyarylate resin (PA), a repeating unit derived from an aromatic diol and a repeating unit derived from an aromatic dicarboxylic acid are adjacent to and bonded to each other. Also, in the polyarylate resin (PA), the terminal group (13) is adjacent to and bonded to the repeating unit derived from the aromatic dicarboxylic acid. Therefore, in the polyarylate resin (PA), the number $N_{BP}$ of repeating units derived from the aromatic diol and the number $N_{DC}$ of repeating units derived from the aromatic dicarboxylic acid satisfy the following equation "$N_{DS}=N_{BP}+1$". In a configuration in which the polyarylate resin (PA) is a copolymer, the polyarylate resin (PA) may be for example a random copolymer, an alternating copolymer, a periodic copolymer, or a block copolymer.

The repeating unit derived from the aromatic diol is for example the repeating unit (11). In a configuration in which the polyarylate resin (PA) includes two or more types of repeating units (11), no specific limitation is placed on arrangement of one type of repeating unit (11) and the other type(s) of repeating unit(s) (11). The one type of repeating unit (11) and the other type(s) of repeating unit(s) (11) may be arranged randomly, alternately, periodically, or on a block-by-block basis, with the repeating unit (12) interposed therebetween. The repeating unit derived from an aromatic dicarboxylic acid is for example the repeating unit (12). In a configuration in which the polyarylate resin (PA) includes two or more types of repeating units (12), no specific limitation is placed on arrangement of one type of repeating unit (12) and the other type(s) of repeating unit(s) (12). The one type of repeating unit (12) and the other type(s) of repeating unit(s) (12) may be arranged randomly, alternately, periodically, or on a block-by-block basis, with the repeating unit (11) interposed therebetween.

The polyarylate resin (PA) may include only the repeating units (11) and (12) as repeating units. Alternatively, the polyarylate resin (PA) may further include a repeating unit that is derived from an aromatic diol and that is different from the repeating unit (11) in addition to the repeating unit (11). Also, the polyarylate resin (PA) may further include a repeating unit that is derived from an aromatic dicarboxylic acid and that is different from the repeating unit (12) in addition to the repeating unit (12).

The viscosity average molecular weight of the polyarylate resin (PA) is preferably at least 10,000, more preferably at least 20,000, further preferably at least 30,000, and particularly preferably at least 40,000. In a configuration in which the viscosity average molecular weight of the polyarylate resin (PA) is at least 10,000, abrasion resistance of the binder resin increases and the photosensitive layer hardly wears down. By contrast, the viscosity average molecular weight of the binder resin is preferably no greater than 80,000, and more preferably no greater than 70,000. In a configuration in which the viscosity average molecular weight of the binder resin is no greater than 80,000, the polyarylate resin (PA) readily dissolves in a solvent for photosensitive layer formation and formation of the photosensitive layer is facilitated.

No specific limitation is placed on a method for producing the polyarylate resin (PA). Examples of methods for producing the polyarylate resin (PA) include condensation polymerization of an aromatic diol for forming a repeating unit, an aromatic dicarboxylic acid for forming a repeating unit, and a chain terminating agent for forming a terminal group. Known synthesis (specific examples include solution polymerization, melt polymerization, and interfacial polymerization) may be adopted as the condensation polymerization.

At least one compound represented by general formula (BP-11) is for example used as the aromatic diol for forming a repeating unit. At least one compound represented by general formula (DC-12) is for example used as the aromatic dicarboxylic acid for forming a repeating unit. A compound represented by general formula (T-13) is used as the chain terminating agent for forming a terminal group. In general formulas (BP-11), (DC-12), and (T-13), $R^{101}$, $R^{102}$, $R^{103}$, $R^{104}$, $R^{105}$, $R^{106}$, $Z^1$, and $R^f$ represent the same as $R^{101}$, $R^{102}$, $R^{103}$, $R^{104}$, $R^{105}$, $R^{106}$, $Z^1$, and $R^f$ in general formulas (11), (12), and (13), respectively. In the following description, compounds represented by general formulas (BP-11), (DC-12), and (T-13) may be referred to as compounds (BP-11), (DC-12), and (T-13), respectively.

(BP-11)

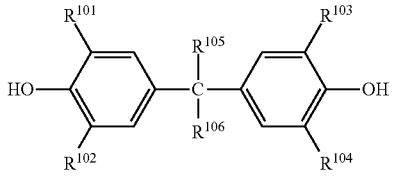

(DC-12)

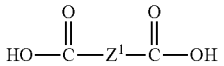

(T-13)

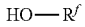

Preferable examples of the compound (BP-11) include compounds represented by chemical formulas (BP-11-1), (BP-11-2), (BP-11-3), and (BP-11-4) (hereinafter may be referred to as compounds (BP-11-1), (BP-11-2), (BP-11-3), and (BP-11-4), respectively).

(BP-11-1)

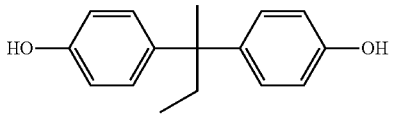

(BP-11-2)

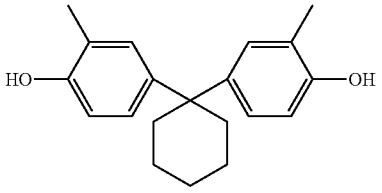

(BP-11-3)

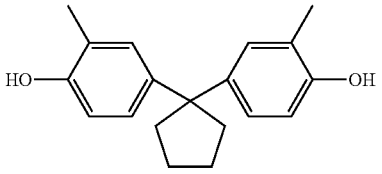

(BP-11-4)

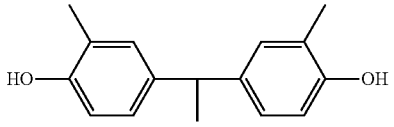

Preferable examples of the compound (DC-12) include compounds represented by chemical formulas (DC-12-1C), (DC-12-2A), (DC-12-2B), and (DC-12-2D) (hereinafter may be referred to as compounds (DC-12-1C), (DC-12-2A), (DC-12-2B), and (DC-12-2D), respectively).

(DC-12-1C)

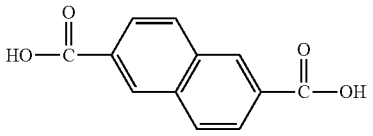

(DC-12-2A)

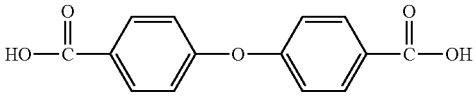

(DC-12-2B)

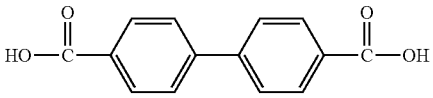

(DC-12-2D)

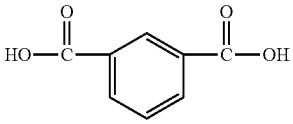

Preferable examples of the compound (T-13) include compounds represented by chemical formulas (T-M1), (T-M2), (T-M3), and (T-M4) (hereinafter may be referred to as compounds (T-M1), (T-M2), (T-M3), and (T-M4), respectively).

(T-M1)

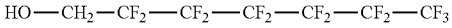

(T-M2)

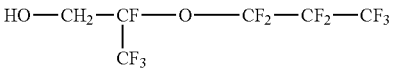

(T-M3)

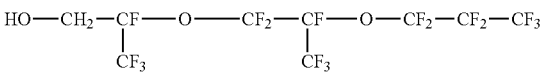

(T-M4)

The aromatic diol (for example, the compound (BP-11)) for forming a repeating unit may be used in the form of an aromatic diacetate. The aromatic dicarboxylic acid (for example, the compound (DC-12)) for forming a repeating unit may be used in the form of a derivative thereof. Examples of derivatives of the aromatic dicarboxylic acid include aromatic dicarboxylic acid dichloride, aromatic dicarboxylic acid dimethyl ester, aromatic dicarboxylic acid diethyl ester, and aromatic dicarboxylic acid anhydride. The aromatic dicarboxylic acid dichloride is a compound obtained through substitution of two chemical groups "—C(═O)—OH" of the aromatic dicarboxylic acid each by a chemical group "—C(═O)—Cl".

Either or both of a base and a catalyst may be added in condensation polymerization of the aromatic diol and the aromatic dicarboxylic acid. A known base and a known catalyst may be appropriately selected as the base and the catalyst. Examples of the base include sodium hydroxide. Examples of the catalyst include benzyltributylammonium chloride, ammonium chloride, ammonium bromide, quaternary ammonium salt, triethylamine, and trimethylamine.

(Hole Transport Material)

Examples of the hole transport material include triphenylamine derivatives, diamine derivatives (specific examples include N,N,N',N'-tetraphenylbenzidine derivative, N,N,N',N'-tetraphenylphenylenediamine derivative, N,N,N',N'-tetraphenylnaphthylenediamine derivative, N,N,N',N'-tetraphenylphenantolylenediamine derivative, and di(aminophenylethenyl)benzene derivative), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. One of the above-listed hole transport materials may be used alone or two or more of the above-listed hole transport materials may be used in combination.

A more specific example of the hole transport material is a compound represented by general formula (20) (hereinafter may be referred to as a compound (20)).

(20)

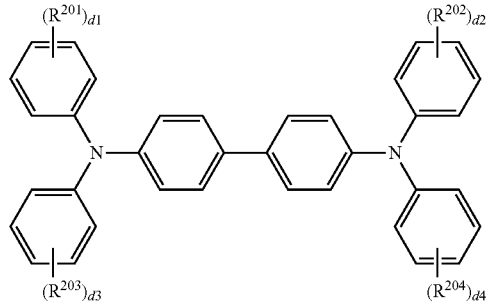

In general formula (20), $R^{201}$, $R^{202}$, $R^{203}$, and $R^{204}$ each represent, independently of one another, an alkyl group having a carbon number of at least 1 and no greater than 6. Also, d1, d2, d3, and d4 each represent, independently of one another, an integer of at least 0 and no greater than 5. When d1 represents an integer of at least 2 and no greater than 5, a plurality of chemical groups $R^{201}$ may be the same as or different from one another. When d2 represents an integer of at least 2 and no greater than 5, a plurality of chemical groups $R^{202}$ may be the same as or different from one another. When d3 represents an integer of at least 2 and no greater than 5, a plurality of chemical groups $R^{203}$ may be the same as or different from one another. When d4 represents an integer of at least 2 and no greater than 5, a plurality of chemical groups $R^{204}$ may be the same as or different from one another.

The alkyl group having a carbon number of at least 1 and no greater than 6 represented by each of $R^{201}$, $R^{202}$, $R^{203}$, and $R^{204}$ is preferably an alkyl group having a carbon number of at least 1 and no greater than 3, and more preferably a methyl group. Preferably, d1, d2, d3, and d4 each represent, independently of one another, 0 or 1. It is more preferable that d1 and d2 each represent 1 and d3 and d4 each represent 0.

A preferable example of the compound (20) is a compound represented by chemical formula (20-H1) shown below (hereinafter may be referred to as a compound (20-H1)).

(20-H1)

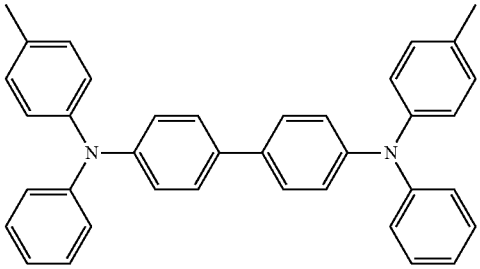

The amount of the hole transport material contained in the photosensitive layer is preferably at least 10 parts by mass and no greater than 200 parts by mass relative to 100 parts by mass of the binder resin, and more preferably at least 10 parts by mass and no greater than 100 parts by mass.

(Combination of Materials)

In order to inhibit generation of white spots in a formed image, the following combinations of a binder resin and an electron transport material are preferable. Also, for the same reason as above, it is preferable to employ any of the following combinations of a binder resin and an electron transport material and use a Y-form titanyl phthalocyanine as a charge generating material. That is:

the binder resin is a polyarylate resin including the repeating units (11-2), (12-1C), and (12-2A) and the terminal group (M1), and the electron transport material is the compound (1), (2), (3), (4), or (5);

the binder resin is a polyarylate resin including the repeating units (11-2), (12-1C), and (12-2A) and the terminal group (M2), and the electron transport material is the compound (2);

the binder resin is a polyarylate resin including the repeating units (11-2), (12-1C), and (12-2A) and the terminal group (M3), and the electron transport material is the compound (2);

the binder resin is a polyarylate resin including the repeating units (11-2), (12-1C), and (12-2A) and the terminal group (M4), and the electron transport material is the compound (2);

the binder resin is a polyarylate resin including the repeating units (11-2), (12-1C), and (12-2B) and the terminal group (M1), and the electron transport material is the compound (2);

the binder resin is a polyarylate resin including the repeating units (11-2), (12-1C), and (12-2D) and the terminal group (M1), and the electron transport material is the compound (2); or the binder resin is a polyarylate resin including the repeating units (11-4), (12-1C), and (12-2A) and the terminal group (M1), and the electron transport material is the compound (2).

In order to inhibit generation of white spots in a formed image, the following combinations of a binder resin and an electron transport material are more preferable. Also, for the same reason as above, it is more preferable to employ any of the following combinations of a binder resin and an electron transport material and use the Y-form titanyl phthalocyanine as a charge generating material. That is:

the binder resin is a polyarylate resin including the repeating units (11-2), (12-1C), and (12-2A) and the terminal group (M1), and the electron transport material is the compound (1-E1), (2-E2), (3-E3), (4-E4), (4-E5), or (5-E6);

the binder resin is a polyarylate resin including the repeating units (11-2), (12-1C), and (12-2A) and the terminal group (M2), and the electron transport material is the compound (2-E2);

the binder resin is a polyarylate resin including the repeating units (11-2), (12-1C), and (12-2A) and the terminal group (M3), and the electron transport material is the compound (2-E2);

the binder resin is a polyarylate resin including the repeating units (11-2), (12-1C), and (12-2A) and the terminal group (M4), and the electron transport material is the compound (2-E2);

the binder resin is a polyarylate resin including the repeating units (11-2), (12-1C), and (12-2B) and the terminal group (M1), and the electron transport material is the compound (2-E2);

the binder resin is a polyarylate resin including the repeating units (11-2), (12-1C), and (12-2D) and the terminal group (M1), and the electron transport material is the compound (2-E2); or the binder resin is a polyarylate resin including the repeating units (11-4), (12-1C), and (12-2A) and the terminal group (M1), and the electron transport material is the compound (2-E2).

In order to inhibit generation of white spots in a formed image, the following combinations of a binder resin, an electron transport material, and a hole transport material are further preferable. Also, for the same reason as above, it is further preferable to employ any of the following combinations of a binder resin, an electron transport material, and a hole transport material and use the Y-form titanyl phthalocyanine as a charge generating material. That is:

the binder resin is a polyarylate resin including the repeating units (11-2), (12-1C), and (12-2A) and the terminal group (M1), the electron transport material is the compound (1-E1), (2-E2), (3-E3), (4-E4), (4-E5), or (5-E6), and the hole transport material is the compound (20-H1);

the binder resin is a polyarylate resin including the repeating units (11-2), (12-1C), and (12-2A) and the terminal group (M2), the electron transport material is the compound (2-E2), and the hole transport material is the compound (20-H1);

the binder resin is a polyarylate resin including the repeating units (11-2), (12-1C), and (12-2A) and the terminal group (M3), the electron transport material is the compound (2-E2), and the hole transport material is the compound (20-H1);

the binder resin is a polyarylate resin including the repeating units (11-2), (12-1C), and (12-2A) and the terminal group (M4), the electron transport material is the compound (2-E2), and the hole transport material is the compound (20-H1);

the binder resin is a polyarylate resin including the repeating units (11-2), (12-1C), and (12-2B) and the terminal group (M1), the electron transport material is the compound (2-E2), and the hole transport material is the compound (20-H1);

the binder resin is a polyarylate resin including the repeating units (11-2), (12-1C), and (12-2D) and the terminal group (M1), the electron transport material is the compound (2-E2), and the hole transport material is the compound (20-H1); or the binder resin is a polyarylate resin including the repeating units (11-4), (12-1C), and (12-2A) and the terminal group (M1), the electron transport material is the compound (2-E2), and the hole transport material is the compound (20-H1).

In order to significantly inhibit generation of white spots in a formed image, the following first through third configurations are more preferable.

First, the first configuration will be described. In the first configuration, the electron transport material is the compound (3), (4), or (5). In the first configuration, in order to significantly inhibit generation of white spots in a formed image, it is preferable that the binder resin is a polyarylate resin including the repeating units (11-2), (12-1C), and (12-2A) and the terminal group (M1) and the electron transport material is the compound (3), (4), or (5). For the same reason as above, it is more preferable that the binder resin is a polyarylate resin including the repeating units (11-2), (12-1C), and (12-2A) and the terminal group (M1) and the electron transport material is the compound (3-E3), (4-E4), (4-E5), or (5-E6). For the same reason as above, it is further preferable that the binder resin is a polyarylate resin including the repeating units (11-2), (12-1C), and (12-2A) and the terminal group (M1), the electron transport material is the compound (3-E3), (4-E4), (4-E5), or (5-E6), and the hole transport material is the compound (20-H1). For the same reason as above, it is particularly preferable that the binder resin is a polyarylate resin including the repeating units (11-2), (12-1C), and (12-2A) and the terminal group (M1), the electron transport material is the compound (3-E3), (4-E4), (4-E5), or (5-E6), the hole transport material is the compound (20-H1), and the charge generating material is the Y-form titanyl phthalocyanine.

Next, the second configuration will be described. In the second configuration, the electron transport material is the compound (2).

In the second configuration, in order to significantly inhibit generation of white spots in a formed image, the following combinations of a binder resin and an electron transport material are preferable. Also, for the same reason as above, it is preferable to employ any of the following combinations of a binder resin and an electron transport material and use the Y-form titanyl phthalocyanine as a charge generating material. That is:

the binder resin is a polyarylate resin including the repeating units (11-2), (12-1C), and (12-2A) and the terminal group (M1), and the electron transport material is the compound (2);

the binder resin is a polyarylate resin including the repeating units (11-2), (12-1C), and (12-2A) and the terminal group (M2), and the electron transport material is the compound (2);

the binder resin is a polyarylate resin including the repeating units (11-2), (12-1C), and (12-2A) and the terminal group (M3), and the electron transport material is the compound (2);

the binder resin is a polyarylate resin including the repeating units (11-2), (12-1C), and (12-2A) and the terminal group (M4), and the electron transport material is the compound (2);

the binder resin is a polyarylate resin including the repeating units (11-2), (12-1C), and (12-2B) and the terminal group (M1), and the electron transport material is the compound (2);

the binder resin is a polyarylate resin including the repeating units (11-2), (12-1C), and (12-2D) and the terminal group (M1), and the electron transport material is the compound (2); or the binder resin is a polyarylate resin including the repeating units (11-4), (12-1C), and (12-2A) and the terminal group (M1), and the electron transport material is the compound (2).

In the second configuration, in order to significantly inhibit generation of white spots in a formed image, the following combinations of a binder resin and an electron transport material are more preferable. For the same reason as above, it is more preferable to employ any of the following combinations of a binder resin and an electron transport material and use the Y-form titanyl phthalocyanine as a charge generating material. That is:

the binder resin is a polyarylate resin including the repeating units (11-2), (12-1C), and (12-2A) and the terminal group (M1) and the electron transport material is the compound (2-E2);

the binder resin is a polyarylate resin including the repeating units (11-2), (12-1C), and (12-2A) and the terminal group (M2), and the electron transport material is the compound (2-E2);

the binder resin is a polyarylate resin including the repeating units (11-2), (12-1C), and (12-2A) and the terminal group (M3), and the electron transport material is the compound (2-E2);

the binder resin is a polyarylate resin including the repeating units (11-2), (12-1C), and (12-2A) and the terminal group (M4), and the electron transport material is the compound (2-E2);

the binder resin is a polyarylate resin including the repeating units (11-2), (12-1C), and (12-2B) and the terminal group (M1), and the electron transport material is the compound (2-E2);

the binder resin is a polyarylate resin including the repeating units (11-2), (12-1C), and (12-2D) and the terminal group (M1), and the electron transport material is the compound (2-E2); or the binder resin is a polyarylate resin including the repeating units (11-4), (12-1C), and (12-2A) and the terminal group (M1), and the electron transport material is the compound (2-E2).

In the second configuration, in order to significantly inhibit generation of white spots in a formed image, the following combinations of a binder resin and an electron transport material are particularly preferable. Also, for the same reason as above, it is particularly preferable to employ any of the following combinations of a binder resin and an electron transport material and use the Y-form titanyl phthalocyanine as a charge generating material. That is:

the binder resin is a polyarylate resin including the repeating units (11-2), (12-1C), and (12-2B) and the terminal group (M1), and the electron transport material is the compound (2-E2); or the binder resin is a polyarylate resin including the repeating units (11-4), (12-1C), and (12-2A) and the terminal group (M1), and the electron transport material is the compound (2-E2).

In the second configuration, in order to significantly inhibit generation of white spots in a formed image, the following combinations of a binder resin, an electron transport material, and a hole transport material are preferable. Also, for the same reason as above, it is preferable to employ any of the following combinations of a binder resin, an electron transport material, and a hole transport material and use the Y-form titanyl phthalocyanine as a charge generating material. That is:

the binder resin is a polyarylate resin including the repeating units (11-2), (12-1C), and (12-2A) and the terminal group (M1), the electron transport material is the compound (2-E2), and the hole transport material is the compound (20-H1);

the binder resin is a polyarylate resin including the repeating units (11-2), (12-1C), and (12-2A) and the terminal group (M2), the electron transport material is the compound (2-E2), and the hole transport material is the compound (20-H1);

the binder resin is a polyarylate resin including the repeating units (11-2), (12-1C), and (12-2A) and the terminal group (M3), the electron transport material is the compound (2-E2), and the hole transport material is the compound (20-H1);

the binder resin is a polyarylate resin including the repeating units (11-2), (12-1C), and (12-2A) and the terminal group (M4), the electron transport material is the compound (2-E2), and the hole transport material is the compound (20-H1);

the binder resin is a polyarylate resin including the repeating units (11-2), (12-1C), and (12-2B) and the terminal group (M1), the electron transport material is the compound (2-E2), and the hole transport material is the compound (20-H1);

the binder resin is a polyarylate resin including the repeating units (11-2), (12-1C), and (12-2D) and the terminal group (M1), the electron transport material is the compound (2-E2), and the hole transport material is the compound (20-H1); or the binder resin is a polyarylate resin including the repeating units (11-4), (12-1C), and (12-2A) and the terminal group (M1), the electron transport material is the compound (2-E2), and the hole transport material is the compound (20-H1).

In the second configuration, in order to significantly inhibit generation of white spots in a formed image, the following combinations of a binder resin, an electron transport material, and a hole transport material are particularly preferable. Also, for the same reason as above, it is particularly preferable to employ any of the following combinations of a binder resin, an electron transport material, and a hole transport material and use the Y-form titanyl phthalocyanine as a charge generating material. That is:

the binder resin is a polyarylate resin including the repeating units (11-2), (12-1C), and (12-2B) and the terminal group (M1), the electron transport material is the compound (2-E2), and the hole transport material is the compound (20-H1); or the binder resin is a polyarylate resin including the repeating units (11-4), (12-1C), and (12-2A) and the terminal group (M1), the electron transport material is the compound (2-E2), and the hole transport material is the compound (20-H1).

Next, the third configuration will be described. In the third configuration, the electron transport material is the compound (1), (4), or (5). In the third configuration, the compound (1) is preferably the compound (1-E1), the compound (4) is preferably the compound (4-E4) or (4-E5), and the compound (5) is preferably the compound (5-E6).

In the third configuration, in order to significantly inhibit generation of white spots in a formed image, it is preferable that the binder resin is a polyarylate resin including the repeating units (11-2), (12-1C), and (12-2A) and the terminal group (M1) and the electron transport material is the compound (1), (4), or (5). For the same reason as above, it is more preferable that the binder resin is a polyarylate resin including the repeating units (11-2), (12-1C), and (12-2A) and the terminal group (M1) and the electron transport material is the compound (1-E1), (4-E4), (4-E5), or (5-E6). For the same reason as above, it is further preferable that the binder resin is a polyarylate resin including the repeating units (11-2), (12-1C), and (12-2A) and the terminal group (M1), the electron transport material is the compound (1-E1), (4-E4), (4-E5), or (5-E6), and the hole transport material is the compound (20-H1). For the same reason as above, it is particularly preferable that the binder resin is a polyarylate resin including the repeating units (11-2), (12-1C), and (12-2A) and the terminal group (M1), the electron transport material is the compound (1-E1), (4-E4), (4-E5), or (5-E6), the hole transport material is the compound (20-H1), and the charge generating material is the Y-form titanyl phthalocyanine.

(Charge Generating Material)

No specific limitation is placed on the charge generating material as long as the charge generating material can be used in the photosensitive member. Examples of the charge generating material include phthalocyanine-based pigment, perylene-based pigment, bisazo pigment, tris-azo pigment, dithioketopyrrolopyrrole pigment, metal-free naphthalocyanine pigment, metal naphthalocyanine pigment, squaraine pigment, indigo pigment, azulenium pigment, cyanine pigment, powders of inorganic photoconductive materials (specific examples include selenium, selenium-tellurium, selenium-arsenic, cadmium sulfide, and amorphous silicon), pyrylium pigment, anthanthrone-based pigment, triphenylmethane-based pigment, threne-based pigment, toluidine-based pigment, pyrazoline-based pigment, and quinacridone-based pigment. One of the above-listed charge generating materials may be used alone or two or more of the above-listed charge generating materials may be used in combination.

Examples of the phthalocyanine-based pigment include metal-free phthalocyanines and metal phthalocyanines. Examples of the metal phthalocyanines include titanyl phthalocyanine, hydroxygallium phthalocyanine, and chlorogallium phthalocyanine. A metal-free phthalocyanine is represented by chemical formula (CGM2), for example. A titanyl phthalocyanine is represented by chemical formula (CGM1), for example.

(CGM1)

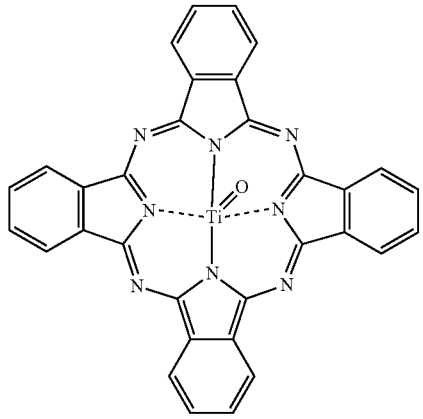

-continued (CGM2)

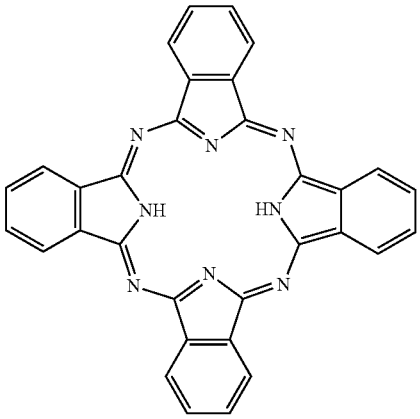

The phthalocyanine-based pigment may be crystalline or non-crystalline. No specific limitation is placed on crystal structure (specific examples include α-form, β-form, Y-form, V-form, and II-form) of the phthalocyanine-based pigment. Phthalocyanine-based pigments having various crystal structures can be used. Examples of crystalline metal-free phthalocyanines include a metal-free phthalocyanine having an X-form crystal structure (hereinafter may be referred to as an X-form metal-free phthalocyanine). Examples of crystalline titanyl phthalocyanines include titanyl phthalocyanines having α-form, β-form, and Y-form crystal structures (hereinafter may be referred to as α-form, β-form, and Y-form titanyl phthalocyanines, respectively).

For image forming apparatuses employing, for example, a digital optical system (for example, a laser beam printer or facsimile machine using a light source such as a semiconductor laser), a photosensitive member having a sensitivity in a wavelength range of 700 nm or longer is preferably used. Phthalocyanine-based pigments are preferable as the charge generating material in terms of their high quantum yield in the wavelength range of 700 nm or longer. Metal-free phthalocyanines and titanyl phthalocyanines are more preferable. The X-form metal-free phthalocyanine and the Y-form titanyl phthalocyanine are further preferable. The Y-form titanyl phthalocyanine is particularly preferable.

The Y-form titanyl phthalocyanine has a main peak for example at a Bragg angle)(2θ±0.2° of 27.2° in a CuKα characteristic X-ray diffraction spectrum. The main peak in the CuKα characteristic X-ray diffraction spectrum is a peak having the largest or second largest intensity in a Bragg angle)(2θ±0.2° range of at least 3° and no greater than 40°.

The following describes an example of a method for measuring the CuKα characteristic X-ray diffraction spectrum. A sample (a titanyl phthalocyanine) is loaded into a sample holder of an X-ray diffraction spectrometer (e.g., "RINT (registered Japanese trademark) 1100" manufactured by Rigaku Corporation) and an X-ray diffraction spectrum is measured using a Cu X-ray tube under conditions of a tube voltage of 40 kV, a tube current of 30 mA, and a wavelength of CuKα characteristic X-rays of 1.542 Å. The measurement range (2θ) is for example at least 3° and no greater than 40° (start angle: 3°, stop angle: 40°), and the scanning rate is for example 10°/minute.

For photosensitive members adopted in image forming apparatuses using a short-wavelength laser light source (for example, a laser light source having a wavelength of at least 350 nm and no longer than 550 nm), anthanthrone-based pigments are preferably used as the charge generating material.

The amount of the charge generating material is preferably at least 0.1 parts by mass and no greater than 50 parts by mass relative to 100 parts by mass of the binder resin contained in the photosensitive layer, more preferably at least 0.5 parts by mass and no greater than 30 parts by mass, and particularly preferably at least 0.5 parts by mass and no greater than 4.5 parts by mass.

(Additives)

Examples of additives include antidegradants (specific examples include antioxidant, radical scavenger, singlet quencher, and ultraviolet absorbing agent), softener, surface modifier, extender, thickener, dispersion stabilizer, wax, acceptor, donor, surfactant, plasticizer, sensitizer, and leveling agent. Examples of the antioxidant include hindered phenols (specific examples include di(tert-butyl)p-cresol), hindered amine, paraphenylenediamine, arylalkane, hydroquinone, spirochromane, spiroindanone, derivatives of the aforementioned materials, organosulfur compounds, and organophosphorus compounds.

<Conductive Substrate>

No specific limitation is placed on the conductive substrate as long as the conductive substrate can be used in the photosensitive member. It is only required that at least a surface portion of the conductive substrate is formed from an electrically conductive material. An example of the conductive substrate is formed from an electrically conductive material. Another example of the conductive substrate is coated with an electrically conductive material. Examples of the electrically conductive material include aluminum, iron, copper, tin, platinum, silver, vanadium, molybdenum, chromium, cadmium, titanium, nickel, palladium, indium, stainless steel, and brass. One of the above-listed electrically conductive materials may be used alone or two or more of the above-listed electrically conductive materials may be used in combination (for example, as an alloy). Among the above-listed electrically conductive materials, aluminum and aluminum alloys are preferable in terms of favorable charge mobility from the photosensitive layer to the conductive substrate.

The shape of the conductive substrate is appropriately selected according to a configuration of an image forming apparatus. Examples of the shape of the conductive substrate include a sheet-like shape and a drum-like shape. Also, the thickness of the conductive substrate is appropriately selected according to the shape of the conductive substrate.

<Intermediate Layer>

The intermediate layer (undercoat layer) contains for example inorganic particles and a resin for the intermediate layer (an intermediate layer resin). The presence of the intermediate layer is thought to cause smooth flow of an electric current generated by irradiation of the photosensitive member with light, resulting in suppression of an increase in resistance while maintaining insulation to such an extent that occurrence of a leakage current can be prevented.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the above-listed inorganic particles may be used alone or two or more types of the above-listed inorganic particles may be used in combination.

No specific limitation is placed on the intermediate layer resin as long as it can be used for formation of the intermediate layer. The intermediate layer may contain an additive. Examples of the additive that may be contained in the intermediate layer are the same as those that may be contained in the photosensitive layer.

<Method for Producing Photosensitive Member>

A photosensitive member is produced for example as described below. The photosensitive member is produced by applying an application liquid for photosensitive layer formation onto a conductive substrate and drying the applied application liquid for photosensitive layer formation. The application liquid for photosensitive layer formation is prepared by dissolving or dispersing a charge generating material, an electron transport material, a binder resin, a hole transport material, and an optionally added component (for example, an additive) in a solvent.

No specific limitation is placed on the solvent contained in the application liquid for photosensitive layer formation as long as the respective components contained in the application liquid can be dissolved or dispersed therein. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. One of the above-listed solvents is used alone or two or more of the above-listed solvents are used in combination. In order to improve workability during production of the photosensitive member, non-halogenated solvents (solvents other than halogenated hydrocarbons) are preferably used.

The application liquid is prepared by mixing the respective components to disperse the components in the solvent. Mixing or dispersion may be performed using for example a bead mill, a roll mill, a ball mill, an attritor, a paint shaker, or an ultrasonic disperser.

The application liquid for photosensitive layer formation may contain for example a surfactant in order to improve dispersibility of the respective components.

No specific limitation is placed on an application method of the application liquid for photosensitive layer formation as long as the application liquid can be uniformly applied onto the conductive substrate. Examples of the application method include blade coating, dip coating, spray coating, spin coating, and bar coating.

No specific limitation is placed on a drying method of the application liquid for photosensitive layer formation as long as the solvent contained in the application liquid can be evaporated. Specific examples of the drying method include thermal treatment (hot-air drying) using a high-temperature dryer or a reduced pressure dryer. The temperature of the thermal treatment is for example at least 40° C. and no higher than 150° C. The time of the thermal treatment is for example at least 3 minutes and no longer than 120 minutes.

Either or both an intermediate layer formation process and a protective layer formation process may be included in the method for producing the photosensitive member, as necessary. A method appropriately selected from known methods is adopted in the intermediate layer formation process and the protective layer formation process.

<Image Forming Apparatus>

The following describes an image forming apparatus including the photosensitive member of the present embodiment. The following describes with reference to FIG. 3 a tandem-type color image forming apparatus as an embodiment of the image forming apparatus including the photosensitive member of the present embodiment.

Figure 3:
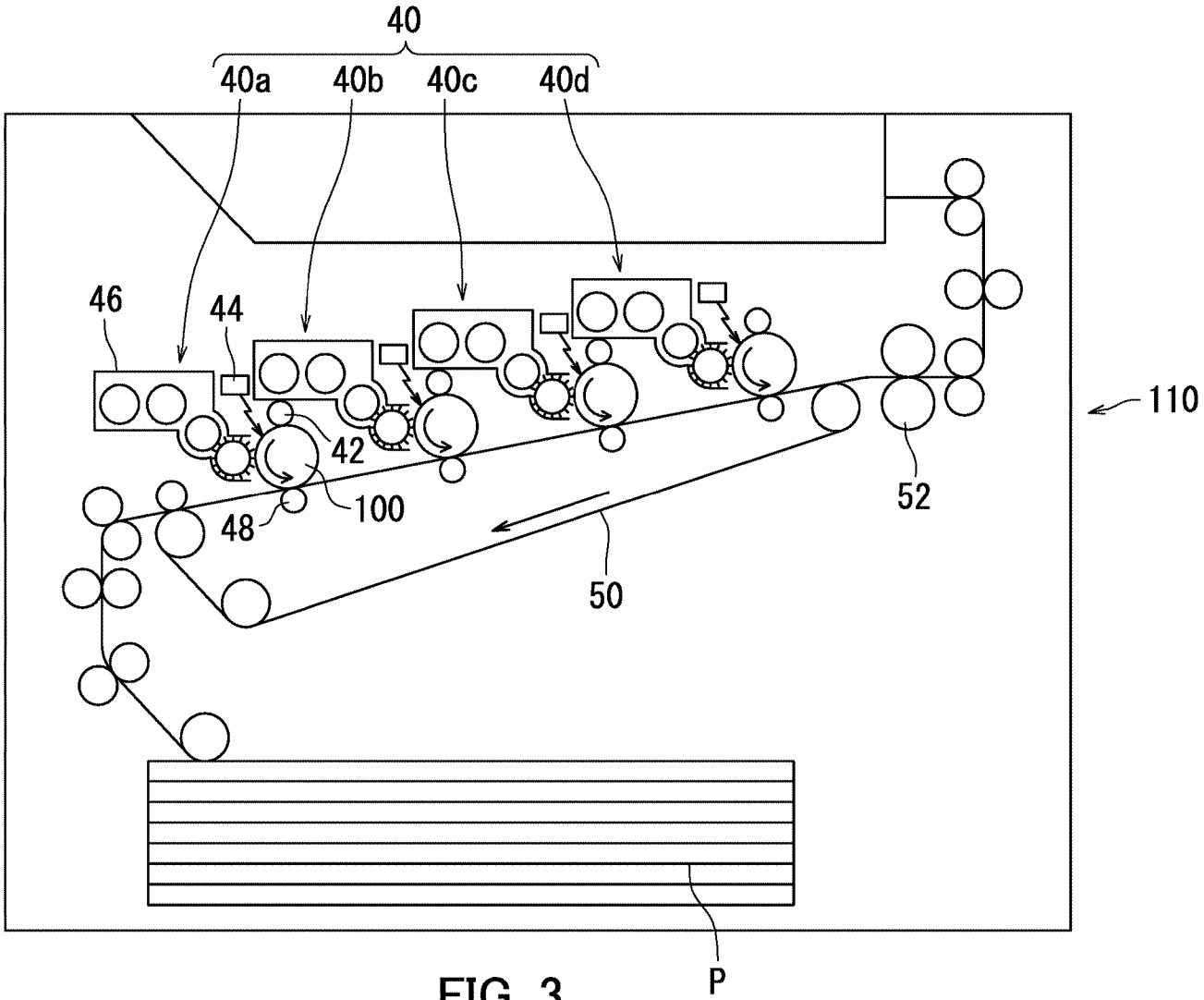
FIG. 3 is a diagram illustrating an example of a configuration of an image forming apparatus including the electrophotographic photosensitive member according to the embodiment of the present disclosure.

An image forming apparatus 110 illustrated in FIG. 3 includes image forming units 40*a*, 40*b*, 40*c*, and 40*d*, a transfer belt 50, and a fixing device 52. In the following description, the image forming units 40*a*, 40*b*, 40*c*, and 40*d* will be referred to as image forming units 40 when there is no need to distinguish the respective image forming units from one another.

Each of the image forming units 40 includes an image bearing member, a charger 42, a light exposure device 44, a developing device 46, and a transfer device 48. The image bearing member is the photosensitive member 100 of the present embodiment. The photosensitive member 100 is located at the center of the image forming unit 40. The photosensitive member 100 is rotatable in a direction indicated by an arrow (i.e., counterclockwise). The charger 42, the light exposure device 44, the developing device 46, and the transfer device 48 are arranged around the photosensitive member 100 in the stated order from the upstream side in the rotation direction of the photosensitive member 100. Note that the image forming unit 40 may further include a non-illustrated cleaning device or a non-illustrated static eliminating device.

The image forming units 40*a* to 40*d* superimpose toner images in respective colors (for example, four colors of black, cyan, magenta, and yellow) on one another in order on a recording medium P placed on the transfer belt 50.

The charger 42 charges a surface (for example, a circumferential surface) of the photosensitive member 100. Charging polarity of the charger 42 is positive. That is, the charger 42 positively charges the surface of the photosensitive member 100. When the photosensitive member 100 of the present embodiment and the recording medium P come into contact with each other and friction is caused therebetween, minute components of the recording medium P (for example, paper dust) are positively charged to a level equal to or higher than a desired level. When the surface of the photosensitive member 100 is positively charged by the charger 42, the surface of the photosensitive member 100 and the minute components of the recording medium P positively charged through triboelectric charging electrically repel each other. As a result, the minute components of the recording medium P hardly adhere to the surface of the photosensitive member 100 and generation of white spots in a formed image can be favorably inhibited.

The charger 42 is a charging roller. The charging roller charges the surface of the photosensitive member 100 while in contact therewith. A contact charging process is adopted in the image forming apparatus 110. In image forming apparatuses adopting the contact charging process, a charging roller in contact with a surface of a photosensitive member normally presses minute components of a recording medium against the surface of the photosensitive member. Therefore, the minute components of the recording medium tend to firmly adhere to the surface of the photosensitive member. However, the image forming apparatus 110 includes the photosensitive member 100 of the present embodiment. Use of the photosensitive member 100 of the present embodiment can inhibit generation of white spots that would be caused by adhesion of minute components. Therefore, even in a configuration in which the image forming apparatus 110 includes the charging roller as the charger 42, minute components hardly adhere to the surface of the photosensitive member 100 and generation of white spots in a formed image can be inhibited.

An example of chargers adopting the contact charging process other than the charging roller is a charging brush. Note that the charger may adopt a non-contact charging process. Examples of chargers adopting the non-contact charging process include a corotron charger and a scorotron charger.

The light exposure device 44 irradiates the charged surface of the photosensitive member 100 with light. Through the above, an electrostatic latent image is formed on the surface of the photosensitive member 100. The electrostatic latent image is formed on the basis of image data input to the image forming apparatus 110.

The developing device 46 develops the electrostatic latent image into a toner image by supplying toner to the surface of the photosensitive member 100. The photosensitive member 100 is the image bearing member that bears the toner image thereon. The toner may be used as a one-component developer. Alternatively, the toner may be mixed with a desired carrier for use of a two-component developer. In a situation in which the toner is used as the one-component developer, the developing device 46 supplies the one-component developer, which is the toner, to the electrostatic latent image formed on the photosensitive member 100. In a situation in which the toner is used in the form of the two-component developer, the developing device 46 supplies to the electrostatic latent image formed on the photosensitive member 100 the toner from the two-component developer containing the toner and the carrier.

The developing device 46 is capable of developing the electrostatic latent image into a toner image while in contact with the surface of the photosensitive member 100. That is, a contact development process can be adopted in the image forming apparatus 110. In image forming apparatuses adopting the contact development process, a developing device in contact with a surface of a photosensitive member normally presses minute components of a recording medium against the surface of the photosensitive member. Therefore, the minute components of the recording medium tend to firmly adhere to the surface of the photosensitive member. However, the image forming apparatus 110 includes the photosensitive member 100 of the present embodiment. Use of the photosensitive member 100 of the present embodiment can inhibit generation of white spots that would be caused by adhesion of minute components of the recording medium P. Therefore, even in a configuration in which the image forming apparatus 110 includes the developing device 46 adopting the contact development process, minute components hardly adhere to the surface of the photosensitive member 100 and generation of white spots in a formed image can be inhibited.

The developing device 46 is capable of cleaning the surface of the photosensitive member 100. That is, a blade cleaner-less process can be adopted in the image forming apparatus 110. In this configuration, the developing device 46 is capable of removing residual components on the surface of the photosensitive member 100. In image forming apparatuses including a cleaning device (for example, a cleaning blade), residual components on a surface of an image bearing member are normally scraped off by the cleaning device. However, in image forming apparatuses adopting the blade cleaner-less process, residual components on the surface of the image bearing member are not scraped off. Therefore, in the image forming apparatuses adopting the blade cleaner-less process, the residual components normally tend to remain on the surface of the image bearing member. However, generation of white spots that would be caused by adhesion of minute components of the recording medium P (for example, paper dust) can be inhibited in the photosensitive member 100 of the present embodiment. Therefore, even in a configuration in which the blade cleaner-less process is adopted in the image forming apparatus 110 including the photosensitive member 100 as above, residual components, particularly the minute components of the recording medium P, hardly remain on the surface of the photosensitive member 100. As a result, generation of white spots in a formed image can be inhibited in the image forming apparatus 110.

In order that the developing device 46 efficiently cleans the surface of the photosensitive member 100 while performing development, it is preferable that the following conditions (a) and (b) are satisfied.

Condition (a): The contact development process is adopted and there is a difference in peripheral speed (rotational speed) between the photosensitive member 100 and the developing device 46.

Condition (b): A surface potential of the photosensitive member 100 and an electric potential of a development bias satisfy the following expressions (b-1) and (b-2).

0 (*V*)<electric potential (*V*) of development bias<surface potential (*V*) of a region of photosensitive member 100 that is not exposed to light (b-1)

electric potential (*V*) of development bias>surface potential (*V*) of a region of photosensitive member 100 that is exposed to light>0 (*V*) (b-2)

In a situation in which the contact development process is adopted and there is a difference in peripheral speed between the photosensitive member 100 and the developing device 46 as described in condition (a), the surface of the photosensitive member 100 comes into contact with the developing device 46 and components adhering to the surface of the photosensitive member 100 are removed by friction between the surface of the photosensitive member 100 and the developing device 46. The peripheral speed of the developing device 46 is preferably faster than that of the photosensitive member 100.

The condition (b) is a condition to be satisfied in a situation in which a reversal development process is adopted as the development process. In order to improve sensitivity characteristics of the photosensitive member 100, which is a single-layer electrophotographic photosensitive member, it is preferable that charging polarity of toner, a surface potential of a region of the photosensitive member 100 that is not exposed to light, a surface potential of a region of the photosensitive member 100 that is exposed to light, and an electric potential of a development bias are all positive. Note that the surface potential of the region of the photosensitive member 100 that is not exposed to light and the surface potential of the region of the photosensitive member 100 that is exposed to light are measured after a toner image is transferred from the photosensitive member 100 to the recording medium P by the transfer device 48 and before the surface of the photosensitive member 100 is charged by the charger 42 in the next turn of the photosensitive member 100.

In a situation in which the expression (b-1) of the condition (b) is satisfied, electrostatic repelling force acting between toner remaining on the photosensitive member 100 (hereinafter may be referred to as residual toner) and the region of the photosensitive member 100 that is not exposed to light is larger than electrostatic repelling force acting between the residual toner and the developing device 46. Therefore, residual toner remaining on the region of the photosensitive member 100 that is not exposed to light moves from the surface of the photosensitive member 100 to the developing device 46 and is collected.

In a situation in which the expression (b-2) of the condition (b) is satisfied, electrostatic repelling force acting between the residual toner and the region of the photosensitive member 100 that is exposed to light becomes smaller than the electrostatic repelling force acting between the residual toner and the developing device 46. Therefore, residual toner remaining on the region of the photosensitive member 100 that is exposed to light is held on the surface of the photosensitive member 100. Toner held on the region of the photosensitive member 100 that is exposed to light is directly used for image formation.

The transfer belt 50 conveys the recording medium P to a site between the photosensitive member 100 and the transfer device 48. The transfer belt 50 is an endless belt. The transfer belt 50 is capable of circulating in a direction indicated by an arrow (i.e., clockwise).

The transfer device 48 transfers the toner image developed by the developing device 46 from the surface of the photosensitive member 100 onto the recording medium P. The transfer device 48 transfers the toner image from the surface of the photosensitive member 100 onto the recording medium P in a manner that the recording medium P and the surface of the photosensitive member 100 are in contact with each other. That is, a direct transfer process is adopted in the image forming apparatus 110. In image forming apparatuses adopting the direct transfer process, a photosensitive member and a recording medium normally come into contact with each other with a result that minute components of the recording medium (for example, paper dust) tend to adhere to a surface of the photosensitive member. However, use of the photosensitive member 100 of the present embodiment can inhibit adhesion of minute components of the recording medium P to the surface of the photosensitive member 100. As a result, generation of white spots in a formed image can be favorably inhibited. An example of the transfer device 48 is a transfer roller.

The fixing device 52 applies heat and/or pressure to the unfixed toner image transferred onto the recording medium P by the transfer device 48. The fixing device 52 is for example a heating roller and/or a pressure roller. Through application of heat and/or pressure to the toner image, the toner image is fixed to the recording medium P. As a result, an image is formed on the recording medium P.

Through the above, an example of the image forming apparatus has been described. However, the image forming apparatus is not limited to the image forming apparatus 110 described above. Although the image forming apparatus 110 described above is a color image forming apparatus, the image forming apparatus may be a monochrome image forming apparatus. In this case, the image forming apparatus may include a single image forming unit only, for example. Although the image forming apparatus 110 described above is a tandem-type image forming apparatus, the image forming apparatus may be a rotary-type image forming apparatus.

<Process Cartridge>

The following describes an example of a process cartridge including the photosensitive member 100 of the present embodiment, continuously referring to FIG. 3. The process cartridge is a cartridge used for image formation. The process cartridge corresponds to each of the image forming units 40*a* to 40*d*. The process cartridge includes the photosensitive member 100. The process cartridge may further include at least one device selected from the group consisting of the charger 42, the light exposure device 44, the developing device 46, and the transfer device 48 in addition to the photosensitive member 100. The process cartridge may further include either or both of a non-illustrated cleaning device and a non-illustrated static eliminating device. The process cartridge is attachable to and detachable from the image forming apparatus 110. Therefore, the process cartridge is easy to handle and can be easily and quickly replaced together with the photosensitive member 100 when sensitivity characteristics of the photosensitive member 100 or the like degrades. Through the above, the process cartridge including the photosensitive member 100 of the present embodiment has been described with reference to FIG. 3.

Use of the above-described photosensitive member of the present embodiment can inhibit generation of white spots in a formed image. Also, use of the process cartridge or the image forming apparatus that includes the photosensitive member of the present embodiment can inhibit generation of white spots in a formed image.

EXAMPLES

The following more specifically describes the present disclosure using examples. However, the present disclosure is by no means limited to the scope of the examples.

<Materials for Forming Photosensitive Layer>

The following charge generating material, hole transport material, electron transport materials, and binder resins were prepared as materials for forming photosensitive layers of photosensitive members.

(Charge Generating Material)

The Y-form titanyl phthalocyanine was prepared as the charge generating material. The Y-form titanyl phthalocyanine was a titanyl phthalocyanine having the Y-form crystal structure and represented by chemical formula (CGM1) described in the above embodiment.

(Hole Transport Material)

The compound (20-H1) described in the above embodiment was prepared as the hole transport material.

(Electron Transport Material)

The compounds (1-E1), (2-E2), (3-E3), (4-E4), (4-E5), and (5-E6) described in the above embodiment were prepared as the electron transport materials. Also, compounds represented by chemical formulas (E7), (E8), (E9), (E10), and (E11) shown below (hereinafter referred to as compounds (E7), (E8), (E9), (E10), and (E11), respectively) were prepared as electron transport materials to be used in comparative examples.

(E7)

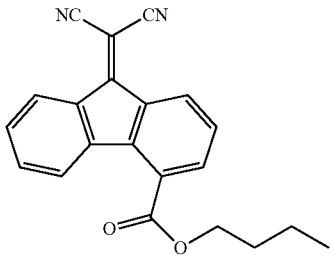

-continued (E8)

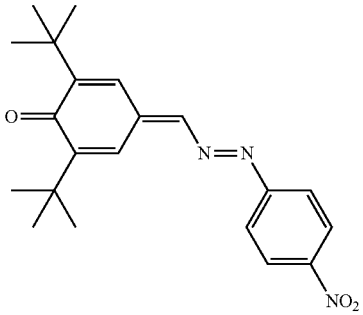

(E9)

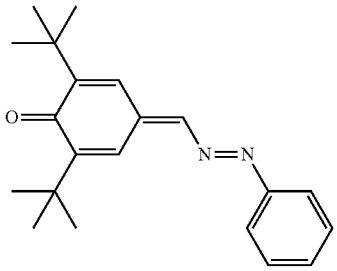

(E10)

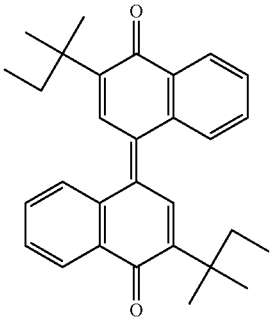

(E11)

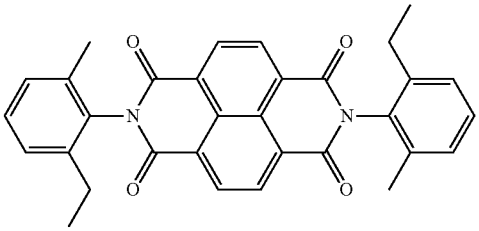

(Binder Resin)

Polyarylate resins (R-1-M1) to (R-1-M4) and (R-2-M1) to (R-5-M1) were prepared as binder resins as described below. Note that a percentage yield of each polyarylate resin was calculated in terms of molar ratio.

[Polyarylate Resin (R-1-M1)]

The polyarylate resin (R-1-M1) included the terminal group (M1). The polyarylate resin (R-1-M1) included only the repeating units (11-2), (12-1C), and (12-2A) as repeating units. The polyarylate resin (R-1-M1) included only one type of repeating unit (11), which was the repeating unit (11-2). The polyarylate resin (R-1-M1) included two types of repeating units (12), which were the repeating units (12-1C) and (12-2A), and the ratios p and q were each 0.50. The polyarylate resin (R-1-M1) had a viscosity average molecular weight of 48,100.

(R-1-M1)

(11-2)

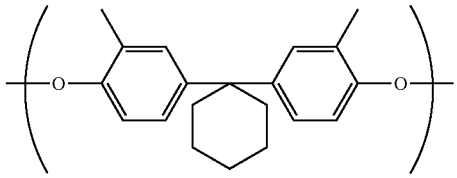

(12-1C)

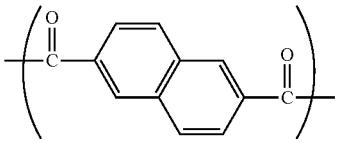

p = 0.50

(12-2A)

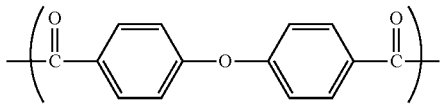

q = 0.50

(M1)

In production of the polyarylate resin (R-1-M1), a 2-L three-necked flask equipped with a thermometer and a three-way cock was used as a reaction vessel. The reaction vessel was charged with 22.14 g (82.56 mmol) of the compound (BP-11-2), 0.281 g (0.826 mmol) of the compound (T-M1), 7.84 g (196 mmol) of sodium hydroxide, and 0.240 g (0.768 mmol) of benzyltributylammonium chloride. The air within the reaction vessel was replaced by argon gas. Then, 600 mL of water was added to the reaction vessel contents. The reaction vessel contents were stirred for one hour at 20° C. Then, the reaction vessel contents were cooled to 10° C. Through the above, an alkaline aqueous solution A was yielded.

Also, 9.84 g (38.9 mmol) of 2,6-naphthalene dicarboxylic acid dichloride (dichloride of the compound (DC-12-1C)) and 11.47 g (38.9 mmol) of 4,4'-oxybisbenzoic acid dichloride (dichloride of the compound (DC-12-2A)) were dissolved in 300 g of chloroform. Through the above, a chloroform solution B was yielded.

The chloroform solution B was added to the alkaline aqueous solution A within the reaction vessel while the alkaline aqueous solution A was stirred at 10° C. Through the above, a polymerization reaction was caused to take place. The polymerization reaction was caused to proceed by stirring the reaction vessel contents for three hours while the temperature (liquid temperature) of the reaction vessel contents was controlled at 13±3° C. Then, an upper layer (water phase) of the reaction vessel contents was removed through decantation to obtain an organic phase. Then, a 2-L conical flask was charged with 500 mL of ion exchanged water. The obtained organic phase was added to the flask content. Further, 300 g of chloroform and 6 mL of acetic acid were added to the flask contents. Then, the flask contents were stirred for 30 minutes at room temperature. Thereafter, an upper layer (water phase) of the flask contents was removed through decantation to obtain an organic phase. The obtained organic phase was washed with 500 mL of ion exchanged water using a separatory funnel. Washing with the ion exchanged water was repeated eight times to obtain an organic phase washed with water.

The organic phase washed with water was filtered to obtain a filtrate. A 3-L beaker was charged with 1.5 L of methanol. The obtained filtrate was gradually dripped into the methanol within the beaker to obtain a sediment. The sediment was collected through filtration. The collected sediment was vacuum-dried for 12 hours at a temperature of 70° C. Through the above, the polyarylate resin (R-1-M1) was yielded. The polyarylate resin (R-1-M1) had a mass yield of 31.0 g and a percentage yield of 80.1%.

[Polyarylate Resin (R-2-M1)]

The polyarylate resin (R-2-M1) included the terminal group (M1). The polyarylate resin (R-2-M1) included only the repeating units (11-2), (12-1C), and (12-2A) as repeating units. The polyarylate resin (R-2-M1) included only one type of repeating unit (11), which was the repeating unit (11-2). The polyarylate resin (R-2-M1) included two types of repeating units (12), which were the repeating units (12-1C) and (12-2A). The ratio p was 0.30 and the ratio q was 0.70. The polyarylate resin (R-2-M1) had a viscosity average molecular weight of 47,600.

(R-2-M1)

(11-2)

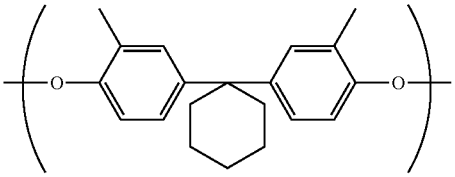

(12-1C)

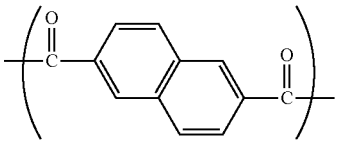

p = 0.30

(12-2A)

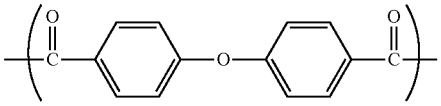

q = 0.70

(M1)

$$—O—CH_2—CF_2—CF_2—CF_2—CF_2—CF_2—CF_3$$

The polyarylate resin (R-2-M1) was produced in the same manner as the polyarylate resin (R-1-M1) in all aspects other than that 23.3 mmol of the dichloride of the compound (DC-12-1C) and 54.5 mmol of the dichloride of the compound (DC-12-2A) were used instead of 38.9 mmol of the dichloride of the compound (DC-12-1C) and 38.9 mmol of the dichloride of the compound (DC-12-2A). The polyarylate resin (R-2-M1) had a mass yield of 31.3 g and a percentage yield of 79.6%.

[Polyarylate Resin (R-3-M1)]

The polyarylate resin (R-3-M1) included the terminal group (M1). The polyarylate resin (R-3-M1) included only the repeating units (11-2), (12-1C), and (12-2B) as repeating units. The polyarylate resin (R-3-M1) included only one type of repeating unit (11), which was the repeating unit (11-2). The polyarylate resin (R-3-M1) included two types of repeating units (12), which were the repeating units (12-1C) and (12-2B), and the ratios p and q were each 0.50. The polyarylate resin (R-3-M1) had a viscosity average molecular weight of 48,900.

(R-3-M1)

(11-2)

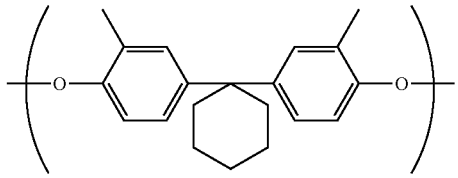

(12-1C)

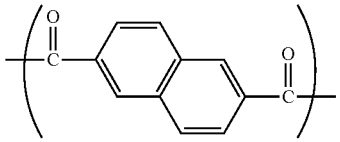

p = 0.50

(12-2B)

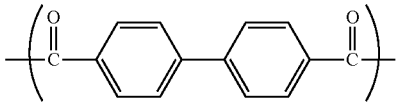

q = 0.50

(M1)

$$—O—CH_2—CF_2—CF_2—CF_2—CF_2—CF_2—CF_3$$

The polyarylate resin (R-3-M1) was produced in the same manner as the polyarylate resin (R-1-M1) in all aspects other than that 38.9 mmol of dichloride of the compound (DC-12-2B) was used instead of 38.9 mmol of the dichloride of the compound (DC-12-2A). The polyarylate resin (R-3-M1) had a mass yield of 30.5 g and a percentage yield of 76.8%.

[Polyarylate Resin (R-4-M1)]

The polyarylate resin (R-4-M1) included the terminal group (M1). The polyarylate resin (R-4-M1) included only the repeating units (11-2), (12-1C), and (12-2D) as repeating units. The polyarylate resin (R-4-M1) included only one type of repeating unit (11), which was the repeating unit (11-2). The polyarylate resin (R-4-M1) included two types of repeating units (12), which were the repeating units (12-1C) and (12-2D), and the ratios p and q were each 0.50. The polyarylate resin (R-4-M1) had a viscosity average molecular weight of 47,600.

(R-4-M1)

(11-2)

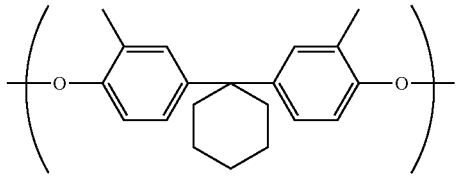

(12-1C)

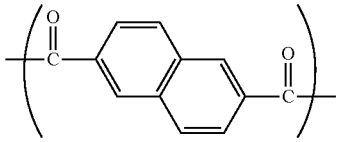

p = 0.50

-continued (12-2D)

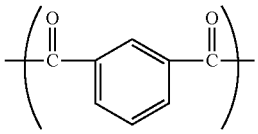

q = 0.50

(M1)

—O—$CH_2$—$CF_2$—$CF_2$—$CF_2$—$CF_2$—$CF_2$—$CF_3$

The polyarylate resin (R-4-M1) was produced in the same manner as the polyarylate resin (R-1-M1) in all aspects other than that 38.9 mmol of dichloride of the compound (DC-12-2D) was used instead of 38.9 mmol of the dichloride of the compound (DC-12-2A). The polyarylate resin (R-4-M1) had a mass yield of 28.9 g and a percentage yield of 78.6%.

[Polyarylate Resin (R-5-M1)]

The polyarylate resin (R-5-M1) included the terminal group (M1). The polyarylate resin (R-5-M1) included only the repeating units (11-4), (12-1C), and (12-2A) as repeating units. The polyarylate resin (R-5-M1) included only one type of repeating unit (11), which was the repeating unit (11-4). The polyarylate resin (R-5-M1) included two types of repeating units (12), which were the repeating units (12-1C) and (12-2A), and the ratios p and q were each 0.50. The polyarylate resin (R-5-M1) had a viscosity average molecular weight of 55,100.

(R-5-M1)

(11-4)

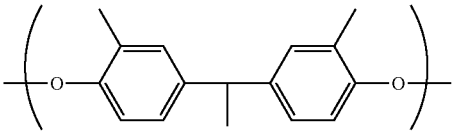

(12-1C)

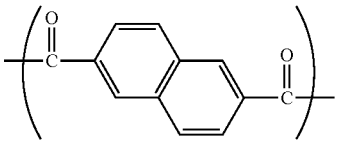

p = 0.50

(12-2A)

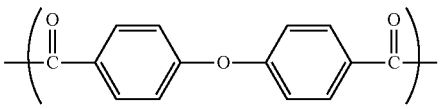

q = 0.50

(M1)

—O—$CH_2$—$CF_2$—$CF_2$—$CF_2$—$CF_2$—$CF_2$—$CF_3$

The polyarylate resin (R-5-M1) was produced in the same manner as the polyarylate resin (R-1-M1) in all aspects other than that 82.56 mmol of the compound (BP-11-4) was used instead of 82.56 mmol of the compound (BP-11-2). The polyarylate resin (R-5-M1) had a mass yield of 27.8 g and a percentage yield of 80.6%.

[Polyarylate Resin (R-1-M2)]

The polyarylate resin (R-1-M2) included the terminal group (M2). The polyarylate resin (R-1-M2) included only the repeating units (11-2), (12-1C), and (12-2A) as repeating units. The polyarylate resin (R-1-M2) included only one type of repeating unit (11), which was the repeating unit (11-2). The polyarylate resin (R-1-M2) included two types of repeating units (12), which were the repeating units (12-1C) and (12-2A), and the ratios p and q were each 0.50. The polyarylate resin (R-1-M2) had a viscosity average molecular weight of 46,800.

(R-1-M2)

(11-2)

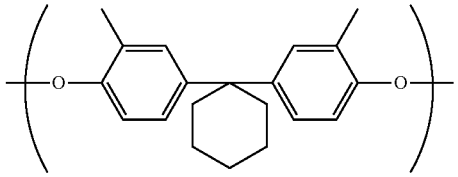

(12-1C)

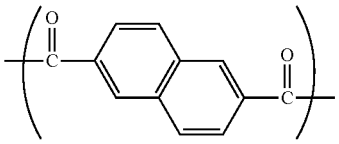

p = 0.50

(12-2A)

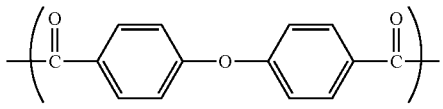

q = 0.50

(M2)

—O—$CH_2$—CF($CF_3$)—O—$CF_2$—$CF_2$—$CF_3$

The polyarylate resin (R-1-M2) was produced in the same manner as the polyarylate resin (R-1-M1) in all aspects other than that 0.826 mmol of the compound (T-M2) was used instead of 0.826 mmol of the compound (T-M1). The polyarylate resin (R-1-M2) had a mass yield of 31.2 g and a percentage yield of 80.6%.

[Polyarylate Resin (R-1-M3)]

The polyarylate resin (R-1-M3) included the terminal group (M3). The polyarylate resin (R-1-M3) included only the repeating units (11-2), (12-1C), and (12-2A) as repeating units. The polyarylate resin (R-1-M3) included only one type of repeating unit (11), which was the repeating unit (11-2). The polyarylate resin (R-1-M3) included two types of repeating units (12), which were the repeating units (12-1C) and (12-2A), and the ratios p and q were each 0.50. The polyarylate resin (R-1-M3) had a viscosity average molecular weight of 49,700.

(R-1-M3)

(11-2)

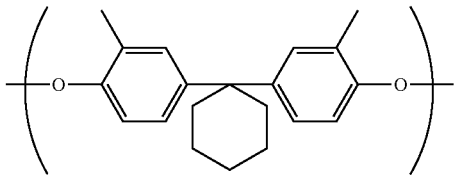

-continued (12-1C)

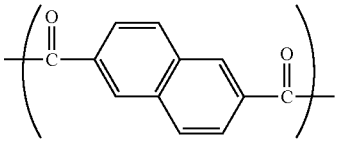

p = 0.50

(12-2A)

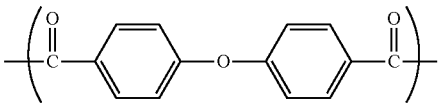

q = 0.50

(M3)

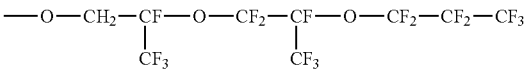

The polyarylate resin (R-1-M3) was produced in the same manner as the polyarylate resin (R-1-M1) in all aspects other than that 0.826 mmol of the compound (T-M3) was used instead of 0.826 mmol of the compound (T-M1). The polyarylate resin (R-1-M3) had a mass yield of 29.1 g and a percentage yield of 75.2%.

[Polyarylate Resin (R-1-M4)]

The polyarylate resin (R-1-M4) included the terminal group (M4). The polyarylate resin (R-1-M4) included only the repeating units (11-2), (12-1C), and (12-2A) as repeating units. The polyarylate resin (R-1-M4) included only one type of repeating unit (11), which was the repeating unit (11-2). The polyarylate resin (R-1-M4) included two types of repeating units (12), which were the repeating units (12-1C) and (12-2A), and the ratios p and q were each 0.50. The polyarylate resin (R-1-M4) had a viscosity average molecular weight of 45,000.

(R-1-M4)

(11-2)

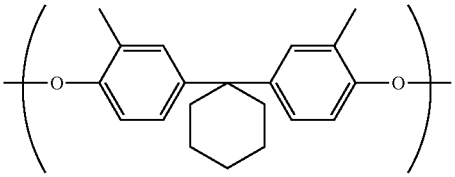

(12-1C)

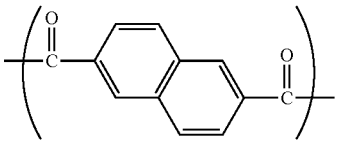

p = 0.50

(12-2A)

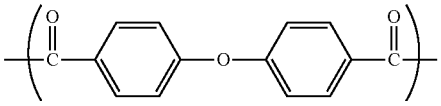

q = 0.50

(M4)

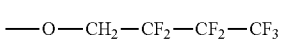

The polyarylate resin (R-1-M4) was produced in the same manner as the polyarylate resin (R-1-M1) in all aspects other than that 0.826 mmol of the compound (T-M4) was used instead of 0.826 mmol of the compound (T-M1). The polyarylate resin (R-1-M4) had a mass yield of 30.2 g and a percentage yield of 78.0%.

Next, polyarylate resins (R-1-MA), (R-3-MA), (R-5-MA), (R-6-MA), and (R-1-MB) as binder resins to be used in the comparative examples were prepared as described below. Note that a percentage yield of each polyarylate resin was calculated in terms of molar ratio.

[Polyarylate Resin (R-1-MA)]

The polyarylate resin (R-1-MA) included the terminal group (MA). The polyarylate resin (R-1-MA) included only the repeating units (11-2), (12-1C), and (12-2A) as repeating units. The polyarylate resin (R-1-MA) included only one type of repeating unit (11), which was the repeating unit (11-2). The polyarylate resin (R-1-MA) included two types of repeating units (12), which were the repeating units (12-1C) and (12-2A), and the ratios p and q were each 0.50. The polyarylate resin (R-1-MA) had a viscosity average molecular weight of 50,300.

(R-1-MA)

(11-2)

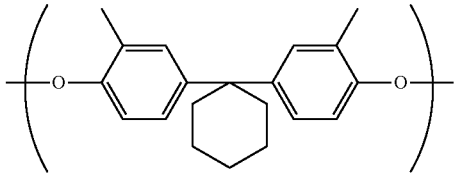

(12-1C)

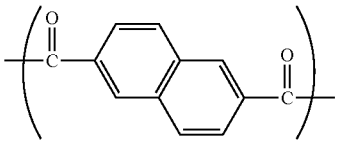

p = 0.50

(12-2A)

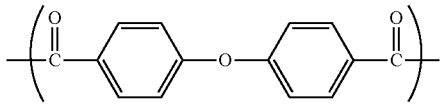

q = 0.50

(MA)

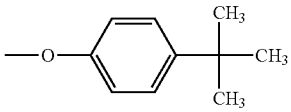

The polyarylate resin (R-1-MA) was produced in the same manner as the polyarylate resin (R-1-M1) in all aspects other than that 0.826 mmol of a compound (p-tert-butyl phenol) represented by chemical formula (T-MA) shown below was used instead of 0.826 mmol of the compound (T-M1). The compound represented by chemical formula (T-MA) is also referred to below as a compound (T-MA). The polyarylate resin (R-1-MA) had a mass yield of 31.1 g and a percentage yield of 80.3%.

(T-MA)

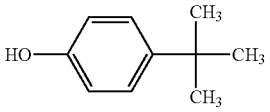

[Polyarylate Resin (R-3-MA)]

The polyarylate resin (R-3-MA) included the terminal group (MA). The polyarylate resin (R-3-MA) included only the repeating units (11-2), (12-1C), and (12-2B) as repeating units. The polyarylate resin (R-3-MA) included only one type of repeating unit (11), which was the repeating unit (11-2). The polyarylate resin (R-3-MA) included two types of repeating units (12), which were the repeating units (12-1C) and (12-2B), and the ratios p and q were each 0.50. The polyarylate resin (R-3-MA) had a viscosity average molecular weight of 46,700.

(R-3-MA)

(11-2)

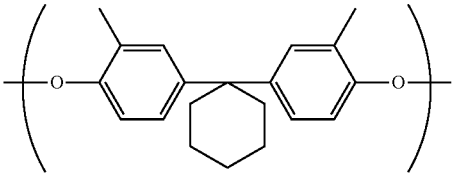

(12-1C)

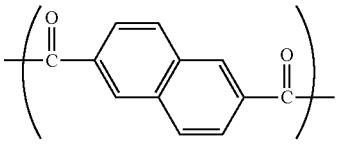

p = 0.50

(12-2B)

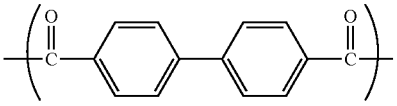

q = 0.50

(MA)

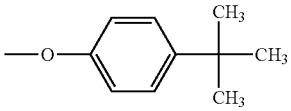

The polyarylate resin (R-3-MA) was produced in the same manner as the polyarylate resin (R-1-M1) in all aspects other than that 38.9 mmol of dichloride of the compound (DC-12-2B) was used instead of 38.9 mmol of the dichloride of the compound (DC-12-2A) and 0.826 mmol of the compound (T-MA) was used instead of 0.826 mmol of the compound (T-M1). The polyarylate resin (R-3-MA) had a mass yield of 30.7 g and a percentage yield of 80.7%.

[Polyarylate Resin (R-5-MA)]

The polyarylate resin (R-5-MA) included the terminal group (MA). The polyarylate resin (R-5-MA) included only the repeating units (11-4), (12-1C), and (12-2A) as repeating units. The polyarylate resin (R-5-MA) included only one type of repeating unit (11), which was the repeating unit (11-4). The polyarylate resin (R-5-MA) included two types of repeating units (12), which were the repeating units (12-1C) and (12-2A), and the ratios p and q were each 0.50. The polyarylate resin (R-5-MA) had a viscosity average molecular weight of 48,800.

(R-5-MA)

(11-4)

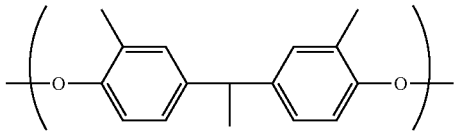

(12-1C)

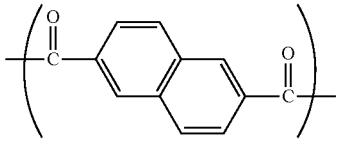

p = 0.50

(12-2A)

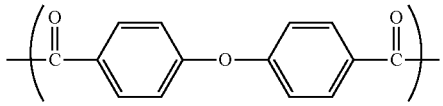

q = 0.50

(MA)

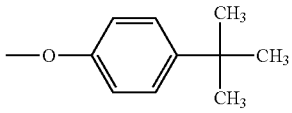

The polyarylate resin (R-5-MA) was produced in the same manner as the polyarylate resin (R-1-M1) in all aspects other than that 82.56 mmol of the compound (BP-11-4) was used instead of 82.56 mmol of the compound (BP-11-2) and 0.826 mmol of the compound (T-MA) was used instead of 0.826 mmol of the compound (T-M1). The polyarylate resin (R-5-MA) had a mass yield of 28.5 g and a percentage yield of 82.6%.

[Polyarylate Resin (R-6-MA)]

The polyarylate resin (R-6-MA) included the terminal group (MA). The polyarylate resin (R-6-MA) included only the repeating units (14), (12-2E), and (12-2D) as repeating units. A ratio of the number of repeating units (12-2E) to a sum of the number of the repeating units (12-2E) and the number of repeating units (12-2D) was 0.50. A ratio of the number of the repeating units (12-2D) to the sum of the number of the repeating units (12-2E) and the number of the repeating units (12-2D) was 0.50. The polyarylate resin (R-6-MA) had a viscosity average molecular weight of 50,100.

(R-6-MA)

(14)

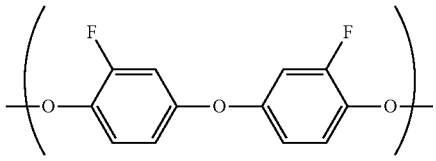

(12-2E)

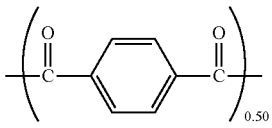

-continued (12-2D)

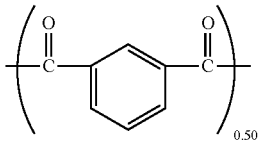

(MA)

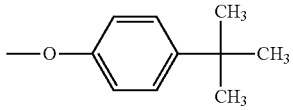

[Polyarylate Resin (R-1-MB)]

The polyarylate resin (R-1-MB) included the terminal group (MB). The polyarylate resin (R-1-MB) included only the repeating units (11-2), (12-1C), and (12-2A) as repeating units. The polyarylate resin (R-1-MB) included only one type of repeating unit (11), which was the repeating unit (11-2). The polyarylate resin (R-1-MB) included two types of repeating units (12), which were the repeating units (12-1C) and (12-2A), and the ratios p and q were each 0.50. The polyarylate resin (R-1-MB) had a viscosity average molecular weight of 49,900.

(R-1-MB)

(11-2)

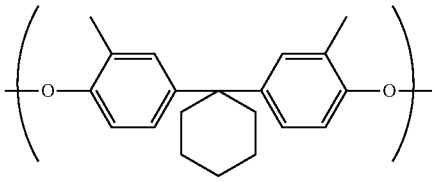

(12-1C)

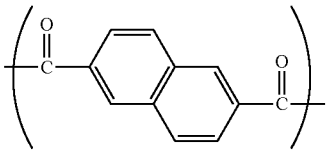

p = 0.50

(12-2A)

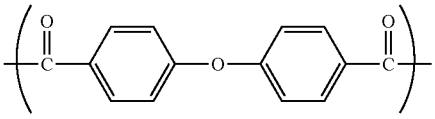

q= 0.50

(MB)

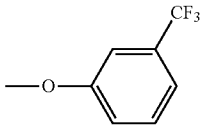

The polyarylate resin (R-1-MB) was produced in the same manner as the polyarylate resin (R-1-M1) in all aspects other than that 0.826 mmol of a compound (3-trifluoromethyl phenol) represented by chemical formula (T-MB) shown below was used instead of 0.826 mmol of the compound (T-M1). The polyarylate resin (R-1-MB) had a mass yield of 29.7 g and a percentage yield of 76.7%.

(T-MB)

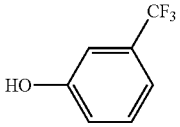

<Production of Photosensitive Member>

Photosensitive members (A-1) to (A-13) and (B-1) to (B-10) were produced using the materials for forming the photosensitive layers.

(Production of Photosensitive Member (A-1))

First, a vessel was charged with 2 parts by mass of the Y-form titanyl phthalocyanine as the charge generating material, 50 parts by mass of the compound (20-H1) as the hole transport material, 30 parts by mass of the compound (2-E2) as the electron transport material, 100 parts by mass of the polyarylate resin (R-1-M1) as the binder resin, and 600 parts by mass of tetrahydrofuran as a solvent. The vessel contents were mixed for 12 hours using a ball mill to disperse the materials in the solvent. Through the above, an application liquid for photosensitive layer formation was prepared. The application liquid for photosensitive layer formation was applied by dip coating onto a drum-shaped aluminum support (diameter: 30 mm, entire length: 238.5 mm) as a conductive substrate. The applied application liquid for photosensitive layer formation was dried with hot air at 120° C. for 80 minutes. Through the above, a photosensitive layer of a single-layer structure (film thickness: 30 μm) was formed on the conductive substrate. As a result, the photosensitive member (A-1) was obtained.

(Production of Photosensitive Members (A-2) to (A-13) and (B-1) to (B-10))

The photosensitive members (A-2) to (A-13) and (B-1) to (B-10) were produced in the same manner as the photosensitive member (A-1) in all aspects other than the following changes. Although the polyarylate resin (R-1-M1) was used as the binder resin in production of the photosensitive member (A-1), binder resins shown in Tables 1 and 2 were used in production of the photosensitive members (A-2) to (A-13) and (B-1) to (B-10). Although the compound (2-E2) was used as the electron transport material in production of the photosensitive member (A-1), electron transport materials shown in Tables 1 and 2 were used in production of the photosensitive members (A-2) to (A-13) and (B-1) to (B-10).

<Measurement of Charge of Calcium Carbonate>

A charge of calcium carbonate was measured for each of the photosensitive members (A-1) to (A-13) and (B-1) to (B-10).

The following describes a method for measuring a charge of calcium carbonate charged by friction between the photosensitive layer 102 and calcium carbonate with reference to FIG. 2 again. The charge of calcium carbonate was measured by first through fourth steps described below. A jig 10 was used in measurement of the charge of calcium carbonate.

The jig 10 includes a first table 12, a rotary shaft 14, a rotary driving device 16 (for example, a motor), and a second table 18. The rotary driving device 16 causes the rotary shaft 14 to rotate. The rotary shaft 14 rotates about a rotation axis S thereof. The first table 12 rotates together with the rotary shaft 14 about the rotation axis S. The second table 18 is fixed and does not rotate.

(First Step)

In the first step, two photosensitive layers 102 were prepared. In the following description, one of the photosensitive layers 102 will be referred to as a first photosensitive layer 102*a* and the other of the photosensitive layers 102 will be referred to as a second photosensitive layer 102*b*. First, a first film 20 with the first photosensitive layer 102*a* formed thereon was prepared. The first photosensitive layer 102*a* had a film thickness L1 of 30 μm. Also, a second film 22 with the second photosensitive layer 102*b* formed thereon was prepared. The second photosensitive layer 102*b* had a film thickness L2 of 30 μm. Overhead projector (OHP) films were used as the first film 20 and the second film 22. The first film 20 and the second film 22 each had a circular shape having a diameter of 3 cm. The application liquid for photosensitive layer formation used in production of the photosensitive member (A-1) was applied onto the first film 20 and the second film 22. The applied application liquid for photosensitive layer formation was dried with hot air at 120° C. for 80 minutes. Through the above, the first film 20 with the first photosensitive layer 102*a* formed thereon and the second film 22 with the second photosensitive layer 102*b* formed thereon were obtained.

(Second Step)

In the second step, 0.007 g of calcium carbonate was applied onto the first photosensitive layer 102*a*. Through the above, a calcium carbonate layer 24 constituted by calcium carbonate was formed on the first photosensitive layer 102*a*. Then, the second photosensitive layer 102*b* was superposed on the calcium carbonate layer 24. Specifically, the second step was performed as described below.

First, the first film 20 was secured to the first table 12 using a double sided tape. Then, 0.007 g of calcium carbonate was applied onto the first photosensitive layer 102*a* on the first film 20. Through the above, the calcium carbonate layer 24 constituted by calcium carbonate was formed on the first photosensitive layer 102*a*. The second film 22 was secured to the second table 18 using the double sided tape such that the calcium carbonate layer 24 comes into contact with the second photosensitive layer 102*b*. As a result, the first table 12, the first film 20, the first photosensitive layer 102*a*, the calcium carbonate layer 24, the second photosensitive layer 102*b*, the second film 22, and the second table 18 were arranged in the stated order from the bottom to the top. The first table 12, the first film 20, the first photosensitive layer 102*a*, the second photosensitive layer 102*b*, the second film 22, and the second table 18 were arranged such that respective centers thereof coincide with the rotation axis S.

(Third Step)

In the third step, the first photosensitive layer 102*a* was rotated at a rotational speed of 60 rpm for 60 seconds while the second photosensitive layer 102*b* was kept stationary in an environment at a temperature of 23° C. and a relative humidity of 50%. Specifically, the rotary shaft 14, the first table 12, the first film 20, and the first photosensitive layer 102*a* were rotated about the rotation axis S at the rotational speed of 60 rpm for 60 seconds by driving the rotary driving device 16. Through the above, calcium carbonate contained in the calcium carbonate layer 24 was charged by friction between calcium carbonate and each of the first photosensitive layer 102*a* and the second photosensitive layer 102*b*.

(Fourth Step)

In the fourth step, the calcium carbonate charged in the third step was collected from the jig 10 and sucked using a charge measuring device (compact draw-off charge measurement system "MODEL 212HS" manufactured by TREK, INC.). A total electric charge Q (unit: +μC) and a mass M (unit: g) of the sucked calcium carbonate were measured using the charge measuring device. A charge (triboelectric charge, unit: +μC/g) of the calcium carbonate was calculated according to an expression "charge=Q/M".

Through the above, the method for measuring the charge of calcium carbonate charged by friction between the photosensitive layer 102 and calcium carbonate has been described with reference to FIG. 2. Other than the following change, a charge of calcium carbonate was measured for each of the photosensitive members (A-2) to (A-13) and (B-1) to (B-10) by the same method as that used in measurement of the charge of calcium carbonate for the photosensitive member (A-1). In the first step, respective application liquids for photosensitive layer formation used in production of the photosensitive members (A-2) to (A-13) and (B-1) to (B-10) were used instead of the application liquid for photosensitive layer formation used in production of the photosensitive member (A-1).

The charge of calcium carbonate calculated for each of the photosensitive members (A-1) to (A-13) and (B-1) to (B-10) is indicated in Table 1 or 2. A larger positive value of the charge of calcium carbonate indicates that calcium carbonate is more liable to be positively charged relative to the photosensitive layer.

<Evaluation of Sensitivity Characteristics>

Sensitivity characteristics were evaluated for each of the photosensitive members (A-1) to (A-13) and (B-1) to (B-10). The sensitivity characteristics were evaluated in an environment at a temperature of 23° C. and a relative humidity of 50%. First, a surface of the photosensitive member was charged to +600 V using a drum sensitivity test device (product of Gen-Tech, Inc.). Then, monochromatic light (wavelength: 780 nm, half-width: 20 nm, light intensity: 1.5 μJ/cm$^2$) was obtained from white light of a halogen lamp using a bandpass filter. The surface of the photosensitive member was irradiated with the obtained monochromatic light. A surface potential of the photosensitive member was measured when 0.5 seconds elapsed from termination of the irradiation. The measured surface potential was determined to be a post-irradiation potential ($V_L$, unit: +V). The measured post-irradiation potential ($V_L$) of each photosensitive member is indicated in Table 2. A smaller positive value of the post-irradiation potential ($V_L$) indicates more excellent sensitivity characteristics of the photosensitive member.

<Evaluation of Image Characteristics>

Image characteristics were evaluated for each of the photosensitive members (A-1) to (A-13) and (B-1) to (B-10). The image characteristics were evaluated in an environment at a temperature of 32.5° C. and a relative humidity of 80%. An image forming apparatus ("Monochrome Printer FS-1300D" manufactured by KYOCERA Document Solutions Inc.) was modified to be used as an evaluation apparatus. Specifically, Monochrome Printer FS-1300D was modified to employ the contact development process rather than the non-contact development process, employ a bladeless cleaning process rather than a blade cleaning process, and adopt a charging roller rather than a scorotron charger. Note that the evaluation apparatus employed a direct transfer process. A recording medium used was "KYOCERA Document Solutions brand paper VM-A4" (A4 size) manufactured by KYOCERA Document Solutions Inc. A one-component developer (prototype) was used in evaluation performed using the evaluation apparatus.

An image I (an image with a coverage rate of 1%) was continuously printed on each of 20,000 sheets of the paper (i.e., the recording medium) using the evaluation apparatus under conditions of a rotational speed of the photosensitive member of 168 mm/second and a charge potential of +630 V. Then, an image II (a black solid image in A4 size) was printed on a sheet of the paper (i.e., the recording medium). The recording medium with the image II formed thereon was observed with unaided eyes and the number of white spots appeared in the image II was counted. The number of white spots in the image II tends to increase with an increase of minute components (for example, paper dust) of the recording medium adhering to the surface of the photosensitive member. The number of white spots appeared in the image II is indicated in Tables 1 and 2.

In Tables 1 and 2, ETM, Resin, and $V_L$ represent the electron transport material, the binder resin, and the post-irradiation potential, respectively. In Tables 1 and 2, Ratio p represents a ratio of the number of repeating units (12-1) to a sum of the number of the repeating units (12-1) and the number of repeating units (12-2). Note that the polyarylate resin (R-6-MA) included as a repeating unit derived from an aromatic diol, the repeating unit (14) instead of the repeating unit (11). As for the polyarylate resin (R-6-MA) that did not include the repeating unit (12-1), a ratio of the number of repeating units (12-2E) to a sum of the number of repeating units (12-2E) and the number of repeating units (12-2D) is indicated in the column for the ratio p.

The photosensitive members (A-1) to (A-13) each included a conductive substrate and a photosensitive layer having a single-layer structure. The photosensitive layer contained a charge generating material, an electron transport material, and a polyarylate resin. The electron transport material included the compound (1), (2), (3), (4), or (5). Specifically, the photosensitive layer contained the compound (1-E1), (2-E2), (3-E3), (4-E4), (4-E5), or (5-E6) as the electron transport material. The polyarylate resin included at least one type of repeating unit (11), at least one type of repeating unit (12), and the terminal group (13). Specifically, the photosensitive layer contained any of the polyarylate resins (R-1-M1) to (R-1-M4), (R-2-M1), (R-3-M1), (R-4-M1), and (R-5-M1). A charge of calcium carbonate charged by friction between the photosensitive layer and calcium carbonate was at least +8.0 μC/g. Therefore, the number of white spots appeared in an image formed using any of the photosensitive members (A-1) to (A-13) was small as indicated in Table 1, which shows that generation of white spots was inhibited through use of the photosensitive members (A-1) to (A-13). Also, generation of white spots in a formed image could be inhibited without impairment of sensitivity characteristics of any of the photosensitive members (A-1) to (A-13).

TABLE 1

| | | Resin | | | | | | Calcium | Sensitivity | Image |
|---|---|---|---|---|---|---|---|---|---|---|
| | Photo-sensitive member | Type | Repeating unit (11) | Repeating unit (12) | Ratio p | Terminal group | ETM | carbonate charge (+μC/g) | characteristics $V_L$ (+V) | characteristics Number of white spots |
| Example 1 | A-1 | R-1-M1 | 11-2 | 12-1C/12-2A | 0.50 | M1 | 2-E2 | 11.6 | 123 | 13 |
| Example 2 | A-2 | R-1-M2 | 11-2 | 12-1C/12-2A | 0.50 | M2 | 2-E2 | 11.3 | 122 | 15 |
| Example 3 | A-3 | R-1-M3 | 11-2 | 12-1C/12-2A | 0.50 | M3 | 2-E2 | 11.8 | 121 | 12 |
| Example 4 | A-4 | R-1-M4 | 11-2 | 12-1C/12-2A | 0.50 | M4 | 2-E2 | 11.6 | 123 | 13 |
| Example 5 | A-5 | R-1-M1 | 11-2 | 12-1C/12-2A | 0.50 | M1 | 1-E1 | 11.3 | 116 | 15 |
| Example 6 | A-6 | R-1-M1 | 11-2 | 12-1C/12-2A | 0.50 | M1 | 3-E3 | 12.1 | 136 | 10 |
| Example 7 | A-7 | R-1-M1 | 11-2 | 12-1C/12-2A | 0.50 | M1 | 4-E4 | 12.2 | 128 | 11 |
| Example 8 | A-8 | R-1-M1 | 11-2 | 12-1C/12-2A | 0.50 | M1 | 4-E5 | 12.4 | 122 | 9 |
| Example 9 | A-9 | R-1-M1 | 11-2 | 12-1C/12-2A | 0.50 | M1 | 5-E6 | 12.1 | 124 | 10 |
| Example 10 | A-10 | R-2-M1 | 11-2 | 12-1C/12-2A | 0.30 | M1 | 2-E2 | 11.9 | 123 | 12 |
| Example 11 | A-11 | R-3-M1 | 11-2 | 12-1C/12-2B | 0.50 | M1 | 2-E2 | 12.0 | 120 | 11 |
| Example 12 | A-12 | R-4-M1 | 11-2 | 12-1C/12-2D | 0.50 | M1 | 2-E2 | 11.7 | 122 | 13 |
| Example 13 | A-13 | R-5-M1 | 11-4 | 12-1C/12-2A | 0.50 | M1 | 2-E2 | 12.2 | 116 | 10 |

TABLE 2

| | | Resin | | | | | | Calcium | Sensitivity | Image |
|---|---|---|---|---|---|---|---|---|---|---|
| | Photo-sensitive member | Type | Repeating unit (11) | Repeating unit (12) | Ratio p | Terminal group | ETM | carbonate charge (+μC/g) | characteristics $V_L$ (+V) | characteristics Number of white spots |
| Comparative example 1 | B-1 | R-1-MA | 11-2 | 12-1C/12-2A | 0.50 | MA | 2-E2 | 7.7 | 121 | 42 |
| Comparative example 2 | B-2 | R-3-MA | 11-2 | 12-1C/12-2B | 0.50 | MA | 2-E2 | 7.3 | 120 | 47 |
| Comparative example 3 | B-3 | R-5-MA | 11-4 | 12-1C/12-2A | 0.50 | MA | 2-E2 | 7.4 | 118 | 46 |
| Comparative example 4 | B-4 | R-1-M1 | 11-2 | 12-1C/12-2A | 0.50 | M1 | E7 | 7.6 | 116 | 43 |
| Comparative example 5 | B-5 | R-1-M1 | 11-2 | 12-1C/12-2A | 0.50 | M1 | E8 | 7.8 | 124 | 40 |
| Comparative example 6 | B-6 | R-1-M1 | 11-2 | 12-1C/12-2A | 0.50 | M1 | E9 | 7.2 | 134 | 50 |
| Comparative example 7 | B-7 | R-1-M1 | 11-2 | 12-1C/12-2A | 0.50 | M1 | E10 | 7.5 | 122 | 43 |
| Comparative example 8 | B-8 | R-1-M1 | 11-2 | 12-1C/12-2A | 0.50 | M1 | E11 | 7.7 | 126 | 41 |
| Comparative example 9 | B-9 | R-1-MB | 11-2 | 12-1C/12-2A | 0.50 | MB | 2-E2 | 7.8 | 124 | 39 |
| Comparative example 10 | B-10 | R-6-MA | None (included repeating unit (14)) | 12-2E/12-2D | 0.50 | MA | 2-E2 | 7.9 | 126 | 37 |

Among the photosensitive members (A-1) to (A-13), the photosensitive members (A-6) to (A-9) each included a photosensitive layer containing a polyarylate resin that included the repeating unit (11-2), the repeating unit (12-1C), the repeating unit (12-2A), and the terminal group (M1). Also, the compound (3-E3), (4-E4), (4-E5), or (5-E6) was contained as the electron transport material in the photosensitive layers of the photosensitive members (A-6) to (A-9). A charge of calcium carbonate charged by friction between the photosensitive layer and calcium carbonate was at least +12.1 μC/g for each of the photosensitive members (A-6) to (A-9). Therefore, the number of white spots appeared in an image formed using any of the photosensitive members (A-6) to (A-9) was no greater than 11 as indicated in Table 1, which shows that generation of white spots was significantly inhibited through use of the photosensitive members (A-6) to (A-9).

Among the photosensitive members (A-1) to (A-13), the photosensitive member (A-11) included a photosensitive layer containing a polyarylate resin that included the repeating unit (11-2), the repeating unit (12-1C), the repeating unit (12-2B), and the terminal group (M1). Also, the compound (2-E2) was contained as the electron transport material in the photosensitive layer of the photosensitive member (A-11). A charge of calcium carbonate charged by friction between the photosensitive layer and calcium carbonate was +12.0 μC/g for the photosensitive member (A-11). Therefore, the number of white spots appeared in an image formed using the photosensitive member (A-11) was 11 as indicated in Table 1, which shows that generation of white spots was significantly inhibited through use of the photosensitive member (A-11).

Among the photosensitive members (A-1) to (A-13), the photosensitive member (A-13) included a photosensitive layer containing a polyarylate resin that included the repeating unit (11-4), the repeating unit (12-1C), the repeating unit (12-2A), and the terminal group (M1). Also, the compound (2-E2) was contained as the electron transport material in the photosensitive layer of the photosensitive member (A-13). A charge of calcium carbonate charged by friction between the photosensitive layer and calcium carbonate was +12.2 μC/g for the photosensitive member (A-13). Therefore, the number of white spots appeared in an image formed using the photosensitive member (A-13) was 10 as indicated in Table 1, which shows that generation of white spots was significantly inhibited through use of the photosensitive member (A-13).

By contrast, the respective polyarylate resins contained in the photosensitive members (B-1) to (B-3) and (B-9) included the terminal group (MA) or (MB). However, the terminal groups (MA) and (MB) were not terminal groups each represented by general formula (13). Specifically, a moiety of the terminal group (MA) corresponding to $R^f$ in general formula (13) was not a chain aliphatic group substituted by at least one fluoro group. Also, a moiety of the terminal group (MB) corresponding to $R^f$ in general formula (13) was not a chain aliphatic group. A charge of calcium carbonate charged by friction between the photosensitive layer and calcium carbonate was smaller than +8.0 μC/g for each of the photosensitive members (B-1) to (B-3) and (B-9). Therefore, a large number of white spots appeared in an image formed using each of the photosensitive members (B-1) to (B-3) and (B-9) as indicated in Table 2, which shows that generation of white spots was not inhibited through use of the photosensitive members (B-1) to (B-3) and (B-9).

The photosensitive layers of the photosensitive members (B-4) to (B-8) each included any of the compounds (E7) to (E11). However, the compounds (E7) to (E11) were not compounds each represented by any of general formulas (1), (2), (3), (4), and (5). Also, a charge of calcium carbonate charged by friction between the photosensitive layer and calcium carbonate was smaller than +8.0 μC/g for each of the photosensitive members (B-4) to (B-8). Therefore, a large number of white spots appeared in an image formed using each of the photosensitive members (B-4) to (B-8) as indicated in Table 2, which shows that generation of white spots was not inhibited through use of the photosensitive members (B-4) to (B-8).

The polyarylate resin contained in the photosensitive member (B-10) included the terminal group (MA). However, the terminal group (MA) was not a terminal group represented by general formula (13). The polyarylate resin contained in the photosensitive member (B-10) also included the repeating unit (14). However, the repeating unit (14) was not a repeating unit represented by general formula (11). Also, a charge of calcium carbonate charged by friction between the photosensitive layer and calcium carbonate was smaller than +8.0 μC/g for the photosensitive member (B-10). Therefore, a large number of white spots appeared in an image formed using the photosensitive member (B-10) as indicated in Table 2, which shows that generation of white spots was not inhibited through use of the photosensitive member (B-10).

The above results show that use of the photosensitive member according to the present disclosure inhibits generation of white spots in a formed image. Also, the above results show that use of the process cartridge or the image forming apparatus according to the present disclosure inhibits generation of white spots in a formed image.

What is claimed is:

1. An electrophotographic photosensitive member comprising a conductive substrate and a photosensitive layer having a single-layer structure, wherein the photosensitive layer contains a charge generating material, an electron transport material, and a binder resin, the electron transport material includes a compound having a halogen atom and represented by a general formula (1), (2), (3), (4), or (5), the binder resin includes a polyarylate resin, the polyarylate resin includes at least one type of repeating unit each represented by a general formula (11), at least one type of repeating unit each represented by a general formula (12), and a terminal group represented by a general formula (13), a charge of calcium carbonate charged by friction between the photosensitive layer and the calcium carbonate is at least +8.0 μC/g, the charge of the calcium carbonate is measured by first through fourth particulars, in the first particular, two photosensitive layers are prepared, each of the two photosensitive layers being the photosensitive layer, one of the two photosensitive layers being a first photosensitive layer, the other of the two photosensitive layers being a second photosensitive layer, the first and second photosensitive layers being in a circular shape of a diameter of 3 cm, in the second particular, 0.007 g of the calcium carbonate is applied onto the first photosensitive layer to form a calcium carbonate layer constituted by the calcium carbonate, and the second photosensitive layer is superposed on the calcium carbonate layer, in the third particular, the first photosensitive layer is rotated at a rotational speed of 60 rpm for 60 seconds while the second photosensitive layer is kept stationary in an environment at a temperature of 23° C. and a relative humidity of 50% to charge the calcium carbonate contained in the calcium carbonate layer through friction between the calcium carbonate and each of the first photosensitive layer and the second photosensitive layer, and in the fourth particular, the charged calcium carbonate is sucked using a charge measuring device, a total electric charge Q and a mass M of the sucked calcium carbonate are measured using the charge measuring device, and the charge of the calcium carbonate is calculated according to an expression Q/M, (1)

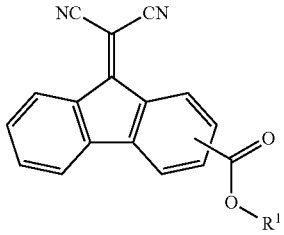

(2)

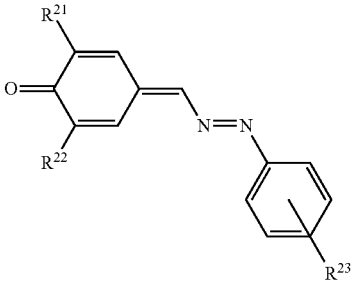

(3)

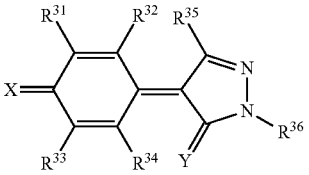

(4)

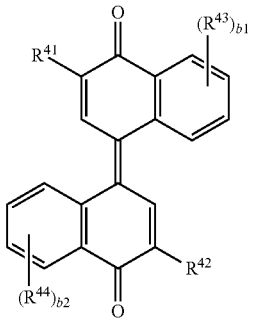

(5)

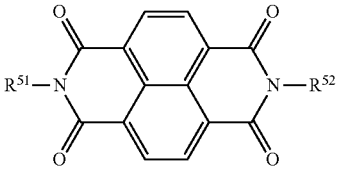

where in the general formula (1), $R^1$ represents: an alkyl group having a carbon number of at least 1 and no greater than 8 and substituted by at least one halogen atom; a cycloalkyl group having a carbon number of at least 3 and no greater than 10 and substituted by at least one halogen atom; an aryl group having a carbon number of at least 6 and no greater than 14, substituted by at least one halogen atom, and optionally substituted by an alkyl group having a carbon number of at least 1 and no greater than 6; a heterocyclic group substituted by at least one halogen atom; or an aralkyl group having a carbon number of at least 7 and no greater than 20 and substituted by at least one halogen atom, in the general formula (2), $R^{21}$ and $R^{22}$ each represent, independently of each other, an alkyl group having a carbon number of at least 1 and no greater than 6, and $R^{23}$ represents a halogen atom, in the general formula (3), $R^{31}$, $R^{32}$, $R^{33}$, $R^{34}$, $R^{35}$, and $R^{36}$ each represent, independently of one another: a halogen atom; a hydrogen atom; an alkyl group having a carbon number of at least 1 and no greater than 6 and optionally substituted by at least one halogen atom; an alkenyl group having a carbon number of at least 2 and no greater than 6 and optionally substituted by at least one halogen atom; an alkoxy group having a carbon number of at least 1 and no greater than 6 and optionally substituted by at least one halogen atom; an aralkyl group having a carbon number of at least 7 and no greater than 20 and optionally substituted by at least one halogen atom; an aryl group having a carbon number of at least 6 and no greater than 14 and optionally substituted by at least one halogen atom; a heterocyclic group optionally substituted by at least one halogen atom; a cyano group; a nitro group; a hydroxyl group; a carboxyl group; or an amino group, with the proviso that at least one of $R^{31}$, $R^{32}$, $R^{33}$, $R^{34}$, $R^{35}$, and $R^{36}$ represents a halogen atom or a chemical group substituted by at least one halogen atom, X represents an oxygen atom, a sulfur atom, or $=C(CN)_2$, and Y represents an oxygen atom or a sulfur atom, in the general formula (4), $R^{41}$ and $R^{42}$ each represent, independently of each other: an alkyl group having a carbon number of at least 1 and no greater than 8 and substituted by at least one halogen atom; an aryl group having a carbon number of at least 6 and no greater than 14, substituted by at least one halogen atom, and optionally substituted by an alkyl group having a carbon number of at least 1 and no greater than 6; an aralkyl group having a carbon number of at least 7 and no greater than 20 and substituted by at least one halogen atom; or a cycloalkyl group having a carbon number of at least 3 and no greater than 20 and substituted by at least one halogen atom, $R^{43}$ and $R^{44}$ each represent, independently of each other, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group, and b1 and b2 each represent, independently of each other, an integer of at least 0 and no greater than 4, in the general formula (5), $R^{51}$ and $R^{52}$ each represent, independently of each other: an aryl group having a carbon number of at least 6 and no greater than 14 and optionally substituted by at least one halogen atom; an aryl group having a carbon number of at least 6 and no greater than 14, substituted by at least one alkyl group having a carbon number of at least 1 and no greater than 6, and optionally substituted by at least one halogen atom; an aryl group having a carbon number of at least 6 and no greater than 14, substituted by at least one benzoyl group, and optionally substituted by at least one halogen atom; an aralkyl group having a carbon number of at least 7 and no greater than 20 and optionally substituted by at least one halogen atom; an alkyl group having a carbon number of at least 1 and no greater than 8 and optionally substituted by at least one halogen atom; or a cycloalkyl group having a carbon number of at least 3 and no greater than 10 and optionally substituted by at least one halogen atom, with the proviso that at least one of $R^{51}$ and $R^{52}$ represents a chemical group substituted by at least one halogen atom, (11)

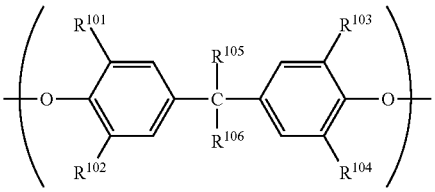

(12)

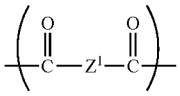

(13)

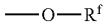

in the general formula (11), $R^{101}$, $R^{102}$, $R^{103}$, and $R^{104}$ each represent, independently of each other, a hydrogen atom or a methyl group, $R^{105}$ and $R^{106}$ each represent, independently of each other, a hydrogen atom or an alkyl group having a carbon number of at least 1 and no greater than 4, and $R^{105}$ and $R^{106}$ may bond together to represent a cycloalkylidene group having a carbon number of at least 5 and no greater than 7, in the general formula (12), $Z^1$ represents a divalent group represented by a chemical formula (12A), (12B), (12C), or (12D), with the proviso that when the polyarylate resin includes only one type of repeating unit represented by the general formula (12), $Z^1$ does not represent a divalent group represented by the chemical formula (12D), and in the general formula (13), $R^f$ represents a chain aliphatic group substituted by at least one fluoro group (12A)

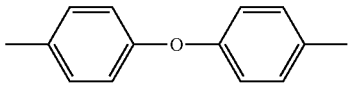

(12B)

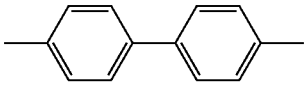

(12C)

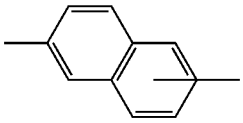

-continued (12D)

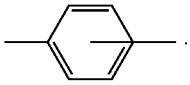

2. The electrophotographic photosensitive member according to claim 1, wherein the polyarylate resin includes at least two types of repeating units each represented by the general formula (12), the at least two types of repeating units each represented by the general formula (12) including a repeating unit represented by a general formula (12-1) and a repeating unit represented by a general formula (12-2), (12-1)

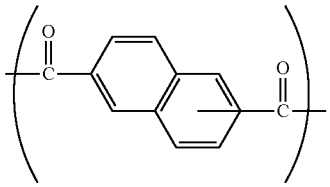

(12-2)

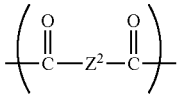

where in the general formula (12-2), $Z^2$ represents a divalent group represented by the chemical formula (12A), (12B), or (12D).

3. The electrophotographic photosensitive member according to claim 1, wherein the terminal group represented by the general formula (13) is a terminal group represented by a general formula (13-1), (13-1)

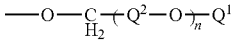

where in the general formula (13-1), $Q^1$ represents a straight or branched perfluoroalkyl group having a carbon number of at least 1 and no greater than 6, $Q^2$ represents a straight or branched perfluoroalkylene group having a carbon number of at least 1 and no greater than 6, n represents an integer of at least 0 and no greater than 2, and when n represents 2, two chemical groups $Q^2$ may be the same as or different from each other.

4. The electrophotographic photosensitive member according to claim 1, wherein the terminal group represented by the general formula (13) is a terminal group represented by a chemical formula (M1), (M2), (M3), or (M4)

(M1)

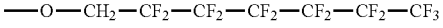

(M2)

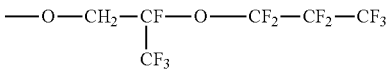

-continued (M3)

$$-O-CH_2-\underset{\underset{CF_3}{|}}{CF}-O-CF_2-\underset{\underset{CF_3}{|}}{CF}-O-CF_2-CF_2-CF_3$$

(M4)

$$-O-CH_2-CF_2-CF_2-CF_3.$$

5. The electrophotographic photosensitive member according to claim 1, wherein in the general formula (1), $R^1$ represents an alkyl group having a carbon number of at least 1 and no greater than 8 and substituted by at least one halogen atom, in the general formula (2), $R^{21}$ and $R^{22}$ each represent, independently of each other, an alkyl group having a carbon number of at least 1 and no greater than 4, and $R^{23}$ represents a halogen atom, in the general formula (3), $R^{31}$, $R^{32}$, $R^{33}$, $R^{34}$, $R^{35}$, and $R^{36}$ each represent, independently of one another, an aryl group having a carbon number of at least 6 and no greater than 14 and substituted by at least one halogen atom or an alkyl group having a carbon number of at least 1 and no greater than 6, with the proviso that at least one of $R^{31}$, $R^{32}$, $R^{33}$, $R^{34}$, $R^{35}$, and $R^{36}$ represents an aryl group having a carbon number of at least 6 and no greater than 14 and substituted by at least one halogen atom, X represents an oxygen atom, and Y represents an oxygen atom, in the general formula (4), $R^{41}$ and $R^{42}$ each represent, independently of each other, an alkyl group having a carbon number of at least 1 and no greater than 8 and substituted by at least one halogen atom or an aralkyl group having a carbon number of at least 7 and no greater than 20 and substituted by at least one halogen atom, and b1 and b2 each represent 0, and in the general formula (5), $R^{51}$ and $R^{52}$ each represent, independently of each other, an aryl group having a carbon number of at least 6 and no greater than 14, substituted by at least one alkyl group having a carbon number of at least 1 and no greater than 6, and optionally substituted by at least one halogen atom or an aralkyl group having a carbon number of at least 7 and no greater than 20 and optionally substituted by at least one halogen atom, with the proviso that at least one of $R^{51}$ and $R^{52}$ represents a chemical group substituted by at least one halogen atom.

6. The electrophotographic photosensitive member according to claim 1, wherein in the general formula (11), $R^{101}$ and $R^{103}$ each represent a methyl group, $R^{102}$ and $R^{104}$ each represent a hydrogen atom, and $R^{105}$ and $R^{106}$ bond together to represent a cycloalkylidene group having a carbon number of at least 5 and no greater than 7.

7. The electrophotographic photosensitive member according to claim 6, wherein the polyarylate resin includes:

a repeating unit represented by a chemical formula (11-2) as the at least one type of repeating unit each represented by the general formula (11);

a repeating unit represented by a chemical formula (12-1C) and a repeating unit represented by a chemical formula (12-2A), (12-2B), or (12-2D), as the at least one type of repeating unit each represented by the general formula (12); and a terminal group represented by a chemical formula (M1), (M2), (M3), or (M4) as the terminal group represented by the general formula (13)

(11-2)

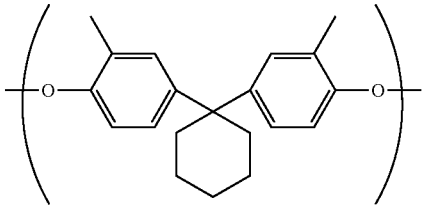

(12-1C)

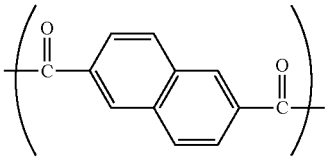

(12-2A)

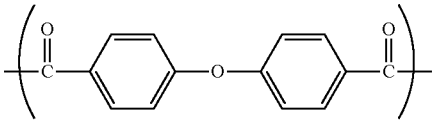

(12-2B)

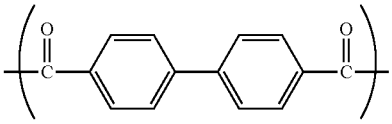

(12-2D)

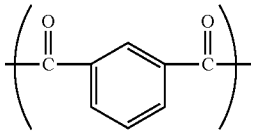

(M1)

$$-O-CH_2-CF_2-CF_2-CF_2-CF_2-CF_2-CF_3$$

(M2)

$$-O-CH_2-\underset{\underset{CF_3}{|}}{CF}-O-CF_2-CF_2-CF_3$$

(M3)

$$-O-CH_2-\underset{\underset{CF_3}{|}}{CF}-O-CF_2-\underset{\underset{CF_3}{|}}{CF}-O-CF_2-CF_2-CF_3$$

(M4)

$$-O-CH_2-CF_2-CF_2-CF_3.$$

8. The electrophotographic photosensitive member according to claim 7, wherein the terminal group is represented by the chemical formula (M1), (M3), or (M4).

9. The electrophotographic photosensitive member according to claim 7, wherein the polyarylate resin includes:

the repeating unit represented by the chemical formula (11-2) as the at least one type of repeating unit each represented by the general formula (11);

the repeating unit represented by the chemical formula (12-1C) and the repeating unit represented by the chemical formula (12-2A), as the at least one type of repeating unit each represented by the general formula (12); and the terminal group represented by the chemical formula (M1) as the terminal group represented by the general formula (13), and the electron transport material includes a compound represented by a chemical formula (3-E3), (4-E4), (4-E5), or (5-E6)

(3-E3)

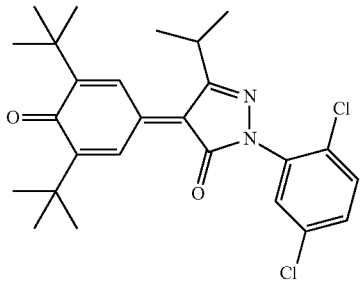

(4-E4)

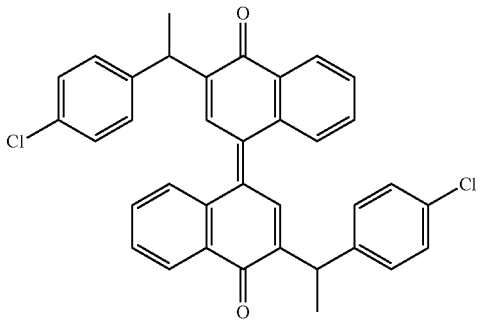

(4-E5)

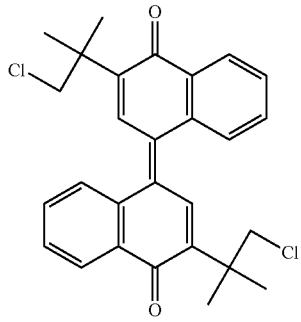

(5-E6)

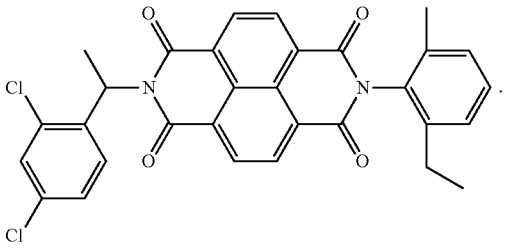

10. The electrophotographic photosensitive member according to claim 7, wherein the polyarylate resin includes:

the repeating unit represented by the chemical formula (11-2) as the at least one type of repeating unit each represented by the general formula (11);

the repeating unit represented by the chemical formula (12-1C) and the repeating unit represented by the chemical formula (12-2B), as the at least one type of repeating unit each represented by the general formula (12); and the terminal group represented by the chemical formula (M1) as the terminal group represented by the general formula (13), and the electron transport material includes a compound represented by a chemical formula (2-E2)

(2-E2)

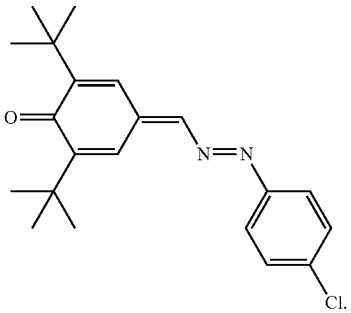

11. The electrophotographic photosensitive member according to claim 1, wherein in the general formula (11), $R^{101}$, $R^{103}$, and $R^{106}$ each represent a methyl group, and $R^{102}$, $R^{104}$, and $R^{105}$ each represent a hydrogen atom.

12. The electrophotographic photosensitive member according to claim 11, wherein the polyarylate resin includes:

a repeating unit represented by a chemical formula (11-4) as the at least one type of repeating unit each represented by the general formula (11);

a repeating unit represented by a chemical formula (12-1C) and a repeating unit represented by a chemical formula (12-2A), as the at least one type of repeating unit each represented by the general formula (12); and a terminal group represented by a chemical formula (M1) as the terminal group represented by the general formula (13)

(11-4)

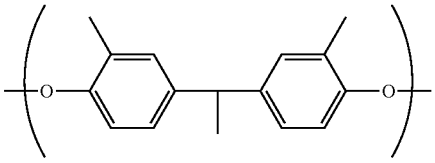

(12-1C)

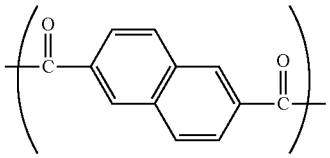

(12-2A)

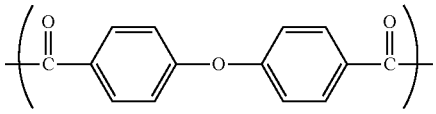

(M1)

$$-O-CH_2-CF_2-CF_2-CF_2-CF_2-CF_2-CF_3.$$

13. The electrophotographic photosensitive member according to claim 12, wherein the electron transport material includes a compound represented by a chemical formula (2-E2)

(2-E2)

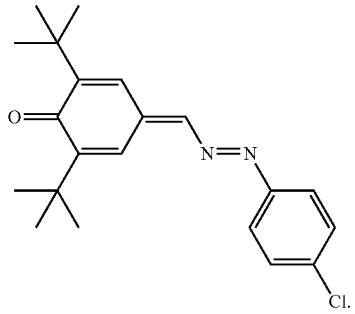

14. The electrophotographic photosensitive member according to claim 1, wherein the electron transport material includes a compound represented by the general formula (1), (4), or (5).

15. The electrophotographic photosensitive member according to claim 14, wherein the compound represented by the general formula (1) is a compound represented by a chemical formula (1-E1), the compound represented by the general formula (4) is a compound represented by a chemical formula (4-E4) or (4-E5), and the compound represented by the general formula (5) is a compound represented by a chemical formula (5-E6)

(1-E1)

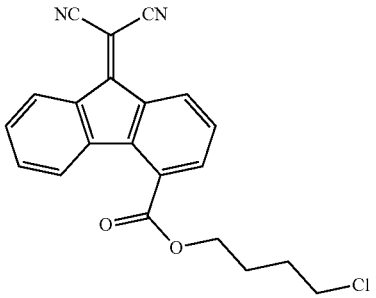

(4-E4)

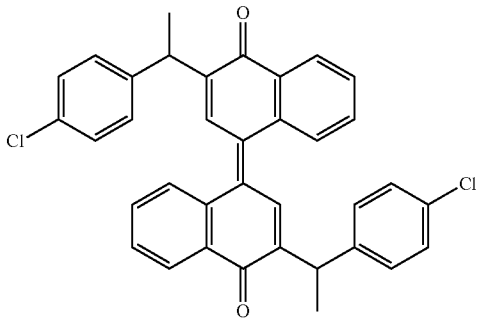

-continued (4-E5)

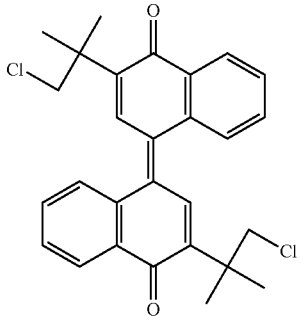

(5-E6)

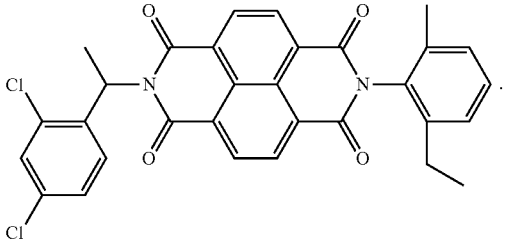

16. A process cartridge comprising the electrophotographic photosensitive member according to claim 1, wherein the process cartridge further comprises at least one selected from the group consisting of a charger, a light exposure device, a developing device, and a transfer device, the charger charges a surface of the electrophotographic photosensitive member, the light exposure device irradiates the charged surface of the electrophotographic photosensitive member with light to form an electrostatic latent image on the surface of the electrophotographic photosensitive member, the developing device develops the electrostatic latent image into a toner image, and the transfer device transfers the toner image from the electrophotographic photosensitive member onto a recording medium.

17. An image forming apparatus comprising:

an image bearing member;

a charger that charges a surface of the image bearing member;

a light exposure device that irradiates the charged surface of the image bearing member with light to form an electrostatic latent image on the surface of the image bearing member;

a developing device that develops the electrostatic latent image into a toner image; and a transfer device that transfers the toner image from the image bearing member onto a recording medium, wherein charging polarity of the charger is positive, the transfer device transfers the toner image from the image bearing member onto the recording medium in a manner that the recording medium and the surface of the image bearing member are in contact with each other, and the image bearing member is the electrophotographic photosensitive member according to claim 1.

* * * * *